United States Patent [19]

Cook, Jr.

[11] Patent Number: 5,025,493

[45] Date of Patent: Jun. 18, 1991

[54] MULTI-ELEMENT ANTENNA SYSTEM AND ARRAY SIGNAL PROCESSING METHOD

[75] Inventor: James Cook, Jr., Tucker, Ga.

[73] Assignee: Scientific-Atlanta, Inc., Atlanta, Ga.

[21] Appl. No.: 360,823

[22] Filed: Jun. 2, 1989

[51] Int. Cl.[5] ..... H01Q 3/02; H01Q 3/12

[52] U.S. Cl. ..... 342/374

[58] Field of Search ..... 342/373, 374, 427, 154, 342/155, 80

[56] References Cited

U.S. PATENT DOCUMENTS

| | | | |
|---|---|---|---|
| 2,677,055 | 4/1954 | Allen | 250/33.63 |
| 3,045,238 | 7/1962 | Cheston | 343/776 |
| 3,419,867 | 12/1968 | Pifer | 343/113 |
| 3,456,260 | 7/1969 | Hannan | 343/755 |
| 3,495,262 | 2/1970 | Paine | 343/776 |
| 3,935,575 | 1/1976 | Leisterer et al. . | |
| 3,993,999 | 11/1976 | Hemmi et al. . | |
| 4,096,482 | 6/1978 | Walters | 343/778 |
| 4,123,759 | 10/1978 | Hines et al. | 343/876 |
| 4,586,051 | 4/1986 | Saitto et al. | 343/703 |
| 4,646,095 | 2/1987 | Kanter | 342/149 |
| 4,704,611 | 11/1987 | Edwards et al. | 342/367 |
| 4,712,110 | 12/1987 | Branigan et al. | 343/779 |
| 4,772,893 | 9/1988 | Iwasaki | 343/779 |

FOREIGN PATENT DOCUMENTS 53-148376 12/1978 Japan .

OTHER PUBLICATIONS

"Five-Horn Feed Improves Monopulse Performance" by Sciambi, Microwaves.

The Handbook of Antenna Design, Chapter 6, published on behalf of the Institute of Electrical Engineers.

"Tracking Systems for Satellite Communications", Hawkins et al, IEEE Proceedings, vol. 135, Pt. F., No. 5, Oct. 1988.

*Primary Examiner*—Theodore M. Blum

*Attorney, Agent, or Firm*—Banner, Birch McKie & Beckett

[57] ABSTRACT

A multi-element antenna feed method and system which has superior side lobe characteristics over previous electronically scanned beam approaches is provided. A multi-element antenna feed system generally comprises a multi-element antenna, an antenna array processor, a receiver, a signal processor for automatic tracking of targets, and an antenna steering control mechanism. The multi-element antenna may comprise alternate configurations and the antenna array processor is coupled to the multi-element antenna. The antenna array processor particularly comprises a diode switching array for combining at least one output of the elements of the multi-element antenna with at least one other output of the multi-element antenna switchably selected via the diode switching array. The method allows control of the antenna system side lobes in both the scanned offset beam plane and the orthogonal plane by an amplitude weighted combination of the selected element beams. This results in an improved capability to reduce crosstalk betwen two orthogonal tracking channels, offset beam control versus frequency, and a wide frequency bandwidth.

50 Claims, 18 Drawing Sheets

MULTI-ELEMENT ANTENNA SYSTEM AND ARRAY SIGNAL PROCESSING METHOD

BACKGROUND OF THE INVENTION

1. Technical Field

The present invention relates to the field of antenna system design and, more particularly, to an antenna system and antenna element array signal processing method in which signals from a plurality of antenna elements formed in an array are processed to provide a considerable improvement in side lobe performance.

2. Discussion of Relevant Art

Automatic angle tracking of targets has been of interest to the technical community for many decades. Automatic tracking is one of the primary considerations in the reception of telemetry data from airborne vehicles today. The vehicles may be a polar orbiting satellite, a geosynchronous satellite, an airplane, or a spin-stabilized rocket, etc.

A number of types of reflector antennas are known which are typically employed for angle tracking. Various techniques of generating offset beams for reflector antennas, for example, sequential lobing, conical scanning, and single channel monopulse, have proven to be acceptable, cost effective means of automatic tracking of targets. The methods utilized in the past are summarized below:

Sequential Lobing

The fundamental feature of sequential lobing is the capability of generating offset beams about the pointing axis (boresight) of a reflector antenna. This is typically accomplished by using four circumferential feed elements placed around a focal axis, the pointing axis, of the reflector antenna, FIG. 8. The physical displacement of the feed phase center from the focal axis generates a beam which is offset by an amount directly proportional to this displacement, FIG. 9. The four discrete offset beams are sampled in a sequential manner and compared in two orthogonal planes to derive an error signal which is used to generate proportional drive signals for a servo system of a motorized axis, the pointing axis, of an antenna positioning system. The limitations of this approach are the amount of gain loss at crossover and the high side lobes created by the extreme beam offsets. This technique is rarely used today because of these limitations.

Conical Scanning

Conical scanning involves the principle of generating an offset beam about the focal axis (tracking axis) by the use of a single feed element which is offset and rotated about the focal axis. The rotation is accomplished in a motor driven, mechanical fashion. There are many variations of conical scanning. These include the early World War II vintage spinning dipoles to more recent optic configurations utilizing fixed feeds with offset spinning subreflectors. The primary advantage of conical scanning is its low implementation cost. Conical scanning also provides better gain performance than conventional sequential lobing in that the beam offset may be controlled to a prescribed crossover level. A low crossover level also minimizes the coma effect in the first side lobe. The characteristics of conical scan tracking offer an attractive alternative for a number of telemetry applications. The disadvantages inherent in conical scanning are low scanning speed, the reliability of the mechanical rotator, and frequency bandwidth limitations. Also conical scanning does not allow the selection of an unmodulated data channel and is not effective in autotracking spin-stabilized targets due to its fixed, low frequency scan rate.

Single Channel Monopulse and Other Recent Developments

The need for a cost effective technique to track spin-stabilized vehicles led to the development of the single channel monopulse tracking system in the late 1960's. Single Channel Monopulse (SCM) utilizes a three channel monopulse feed (in typically four or five element configurations) and a combining network to generate a reference signal and azimuth and elevation difference signals of a monopulse feed. (FIG. 10 shows a four element array system and FIG. 11 a five element array system.) The azimuth and elevation difference signals are biphase modulated and sequentially coupled to the reference signal. (FIG. 12 shows a block diagram of the monoscan converter of FIG. 11.) The resultant signal is of the same form as conical scanning signals in that the combined reference and difference signal produces an offset beam relative to the focal axis. The azimuth and elevation error signals are available in a time sequenced manner.

SCM overcomes the fixed low frequency scan rate of a conical scan tracking configuration by using very fast electronic switches for selecting offset beam positions. In addition, SCM allows the signal combining circuitry to be configured such that the data channel can be independent of the tracking channel and therefore free of the modulation created by the scanning beam. The flexibility of SCM has made it the predominant choice for telemetry tracking applications for the last two decades.

It is generally recognized that by increasing the number of elements applied in an antenna system it is possible to greatly improve antenna performance. However, as the number of elements increase so do the complexities of processing data obtained from the elements. U.S. Pat. No. 4,772,893 relates to a switched steerable multiple beam antenna system wherein the antenna system comprises a five-element cross array. Diagonal quarter wave plates in the five wave guides alter polarization from circular to orthogonal linear providing transmitter/receiver isolation. Each of five branches of the array for feeding antenna power include a switchable time-delay element. Desirable incremental time delays are switchably introduced into each branch and the signals recombined thereafter to form each beam.

Walters, U.S. Pat. No. 4,096,482 discloses a monopulse antenna with a complex array structure of elements which may be reduced to a quad-ridge array processed by summing and differencing data from the pairs of the elements resulting in elevation difference, sum guard and azimuth difference outputs at the output of hybrid circuits.

In an article entitled "Tracking System for Satellite Communications, " by G. J. Hawkins et al., in the IEE Proceedings, Vol. 135, Pt. F, No. 5, October, 1988, prior art automatic tracking antenna systems are generally described. One disclosed automatic tracking system, the Rude Skov. II satellite receiver located in the Netherlands, uses a beam squinting technique comprising a central dipole element around which are located four equally positioned parasitic dipole elements. The individual parasitic dipole elements are made idle (not working) or short circuited (working) to form a squinted beam.

Edwards et al., U.S. Pat. No. 4,704,611, incorporated herein by reference, discloses an electronic tracking system for microwave antennas which uses a reception mode conversion technique to detect a tracking error and subsequently correct the beam steering. The technique uses mode generators to vary the excitation mode of off-axis antenna elements which can be in either the azimuth or elevation plane. The off-axis signal is coupled into the on-axis antenna element signal to achieve antenna beam pointing by beam squinting.

None of these known systems eliminate the requirement for comparators. Further, any improvement in side lobe performance measurable from array processing will be reflected in an improvement in tracking accuracy of the antenna system. Consequently, while these known systems generally demonstrate improved monopulse performance through maximizing the application of a multi-element array, a problem remains in the art for obtaining further side lobe reduction and hence improved aperture distribution for the control of side lobes. Also, the use of comparators as represented by Walters may introduce a problem of crosstalk between the channels represented by cross coupling of error signals. Consequently, there is also the opportunity to improve the crosstalk isolation between channels in known antenna systems.

In Chapter 6 of The Handbook of Antenna Design, published in 1986 on behalf of the Institute of Electrical Engineer, a method for generating a smoothly scanned beam of a multi-element antenna array is described. The author of Chapter 6, Leon J. Ricardi, mathematically develops a method which uses variable amplitude excitation of adjacent elements to point the beam in space. Further, the relative phase of the excitation of each element is adjusted to increase the directive gain of the array. This technique is used to steer a transmission beam of a satellite across the antenna array field-of-view, and the author further suggests that the technique may be applied for signal reception at the satellite.

Disadvantages of SCM configurations and improvements to such configurations in part related to the number of feed elements required. The four element monopulse array feed results in a primary reference beam which is suitable only for large focal length-to-diameter (F/D) ratios. The four element feed also has bandwidth limitations similar to conical scan. The side lobe performance for the four element feed is typically quite acceptable in that the offset secondary beam has side lobe suppression greater than 20 dB with respect to the main beam peak. However, the limitations of the four element feed are its limited bandwidth and aperture illumination efficiency.

A five element feed configuration overcomes the two limitations of the four element feed but introduces a new disadvantage, that of high side lobes in the scanned secondary beams. The peak side lobe of the tracking beam is typically 15 dB to 17 dB below the main beam peak. The 15 dB to 17 dB side lobe reductions is almost invariant with frequency. The high side lobe generation can be understood when one considers that the offset beam is formed by the superposition of three beams in space, one each from the three elements of the feed array in the offset beam plane. It should be pointed out that the side lobes in an unmodulated data channel do not have these high side lobes.

The three beams are combined with the following phase and amplitude coefficients (i.e. in azimuth):

| | Right Beam | Center Beam | Left Beam |
|---|---|---|---|
| Amplitude | k | 1.0 | K |
| Phase (deg) | 0.0 | 0.0 | 180.0 |

Where k is the coupling coefficient of the combining network in FIG. 12. Referring to FIG. 13A, the first side lobe of the center beam is at the same approximate angular position and in-phase with the main lobe of the left beam. Now referring to FIG. 13B, the left beam and the center beam add in-phase and produce an undesirably high side lobe to the right of the boresight axis. Likewise, the undesirable high side lobe (dashed line) to the left of the boresight axis is created by the combination of the center beam and the right beam.

An alternate way of understanding the behavior of the SCM feed is to analyze the combined feed signals that generate the offset beam. The array pattern of the three elements in the azimuth plane is given by $$E(Theta,Phi)=[1+i(2*k)\mathrm{Sin}(Pi*d*\mathrm{Sin}(Theta))]*EE(Theta,Phi) \quad (1)$$

where d is the element spacing in wavelengths;

k is the amplitude coefficient of the offset elements (determined by coupling factor);

Theta is the angle in degrees in the plane of scan;

Phi is the angle in degrees in the elevation plane;

Pi is 3.14159;

i is the square root of $-1$; and

EE(Theta,Phi) is the individual element pattern.

The amplitude and phase of the array voltage pattern is given by $$\begin{aligned} |E(\mathrm{Theta})| &= [Re(E(\mathrm{Theta}))^2 + Im(E(\mathrm{Theta}))^2]^{0.5}*EE(\mathrm{Theta}) \\ &= [1.0 + (2*k*\mathrm{Sin}(\mathrm{Theta})^2]^{0.5}*EE(\mathrm{Theta}) \end{aligned} \quad (2)$$

$$\begin{aligned} \mathrm{Phase}(\mathrm{Theta}) &= \mathrm{Arctan}[Im(E(\mathrm{Theta}))/Re(E(\mathrm{Theta}))] \\ &= \mathrm{Arctan}[2*k*\mathrm{Sin}(\mathrm{Theta})] \end{aligned} \quad (3)$$

An examination of Equation (2) shows that the amplitude illumination on a reflector from the three elements is not substantially different from a single element. The sine(Theta) function, minimum at 0 degrees and maximum at 90 degrees, broadens the array pattern. Equation (3) shows that the phase illumination is directly proportional to a sine function, an odd function. The phase of the illumination is increasingly positive on one side and increasingly negative on the opposite side of the reflector as the distance from the center increases. This phase distribution causes the beam to be steered off axis. Prior art FIG. 14 shows amplitude patterns for two orthogonal planes to show symmetry and FIG. 15 shows the calculated phase functions for a typical five element SCM feed. Prior art FIGS. 16A and 16B represent the secondary patterns of a reflector antenna fed by this feed pattern in the unscanned and scanned planes, respectively. The peak side lobes are 16 dB down from the main beam in the unscanned plane and 15 dB down from the main beam in the scanned plane.

The performance of SCM can be summarized as follows:

(a) Electronic switching circuits allow flexibility in scan rates which feature overcomes the problem with tracking spin-stabilized vehicles;
(b) The data channel can be configured independent from the tracking channel eliminating scan modulation on the data;
(c) There are no mechanically rotating devices;
(d) High reliability; and
(e) Cost effectiveness.

The primary disadvantages of SCM are that is produces high side lobes in the scanned plane which can influence low elevation angle tracking and is susceptible to crosstalk.

SUMMARY OF THE INVENTION

With this background of the invention in mind, it is therefore a primary objective of this invention to provide an improved multi-element array and antenna array signal processor for a more tapered amplitude distribution to illuminate a reflector antenna.

It is a further object of the present invention to provide a signal processing means for reducing the side lobes of an antenna array.

It is a further object of the present invention to provide a reduction in the side lobes of the antenna array in the scanned and unscanned planes.

It is a further object of the present invention to effectively minimize crosstalk between orthogonal channel elements of the antenna array.

It is a further object of the present invention to provide an overall tracking accuracy superior to that of single channel monopulse techniques and approaching the accuracy of full monopulse techniques.

It is a further object of the present invention to provide broadband frequency operation.

It is a further object of the present invention to simplify an antenna array processor by eliminating any requirement for comparators.

The problems and related problems of known monopulse antenna systems are solved by the principles of the present invention, a multi-element array antenna system comprising a signal processing circuit responsive to signal output of a multi-element array for providing steering signal outputs for coupling, for example, to a pedestal drive subsystem for directing the antenna. A side lobe reduction is achieved by combining a central feed element of the array with one of the offset elements rather than with two of the elements in a phase opposition configuration as in conventional systems. An improved aperture distribution results in combining the central element with each of the offset elements. Also, the present invention reduces the cross coupling between the azimuth and elevation channels. This cross coupling, defined as crosstalk, produces an error signal in one orthogonal plane when there is angular movement in the other orthogonal plane. The present configuration involves coupling orthogonal channel elements in-phase. No offset or error signal is introduced by the coupling in the same phase, so crosstalk suppression between channels is improved to at least 30 dB. The present invention differs from SCM in that a SCM feed configuration allows orthogonal plane elements to be parasitically coupled to the active elements with an anti-phase condition which gives rise to a low level crosstalk component. The anti-phase condition in SCM exists because of the use of magic tee apparatus in the monopulse comparator.

The present invention uses multi-element arrays, similar to the four or five element arrays presently being used for SCM systems. The antenna array processor comprises a feed combining network which differs from that of known SCM techniques as it results in an amplitude taper in the aperture plane of the array while maintaining similar phase characteristics across the aperture. This is accomplished by varying the amplitude weighting factors of the array elements. Consequently, the present invention is not dependent on the anti-phase excitation of two elements located symmetrically about an on-axis central element. The feed configuration according to the present invention, devoid of anti-phase excitation, essentially eliminates orthogonal antenna element crosstalk.

In particular, an antenna array signal processor according to the present invention comprises a multiple antenna element array, a signal switching network coupled to the array for selecting from a plurality of signals output from the array and a signal coupler for coupling a selected signal with another signal of the array.

Furthermore, a method of providing an antenna steering signal according to the present invention comprises the steps of selecting at least one signal of signals from the multiple antenna element array, amplitude weighting the selected at least one signal and summing the amplitude weighted signal with at least one other signal of the signals output from the array, the resulting signal being the steering signal for the antenna system.

DETAILED DESCRIPTION

Figure 1:
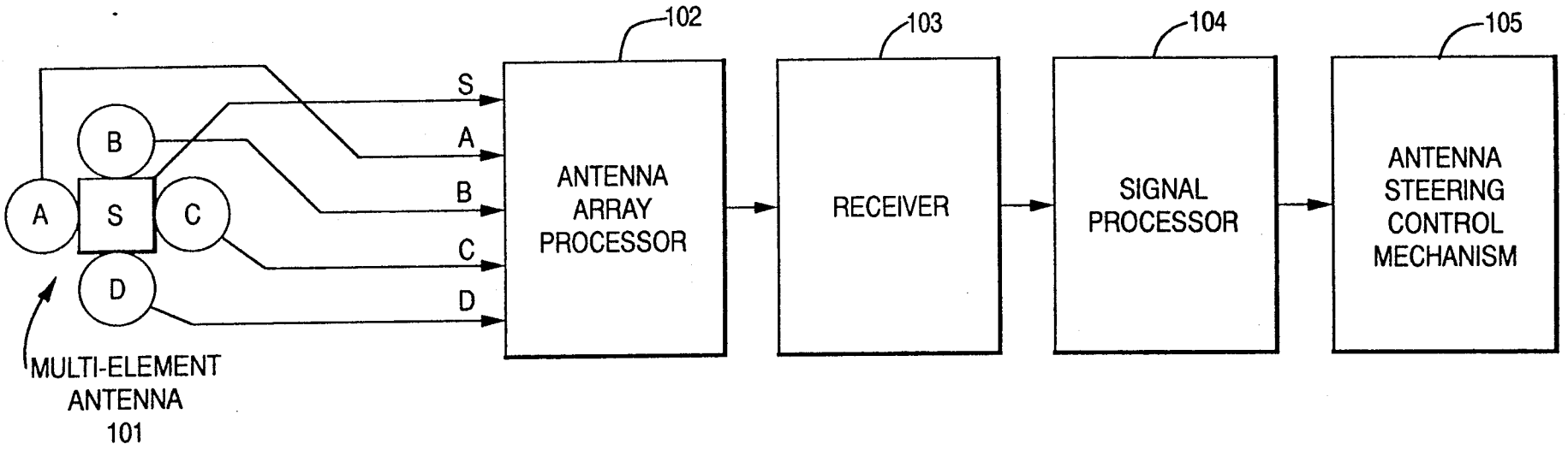
FIG. 1 is a simplified block diagram of a multi-element antenna array receiver system according to the present invention.

Referring to FIG. 1, there is shown a multi-element antenna feed and signal processing system according to the present invention. A multi-element antenna array 101 comprises a plurality of elements for example, A, B, C, D and S. Such an antenna array can utilize polarizing elements as described in Iwasaki, U.S. Pat. No. 4,772,893. The present invention is not limited to any particular choice of polarization technique. Polarization apparatus may be chosen for the particular application of the present invention and is not shown in the drawings.

In known SCM systems, typically outer elements, A, B, C, and D surround a central feed element S which are coupled to a signal combining circuit, a receiver 103 and a signal processor 104. The antenna array receives a combined tracking and data channel. As described above, the signals are combined and processed and a motor driving the antenna may automatically track an airborn target via antenna steering control mechanism 105.

One technique and apparatus for automatic tracking which may be used in accordance with the present invention is described by U.S. Pat. No. 3,419,867 to Peter M. Pifer entitled "Automatic Tracking System Utilizing Coded Scan Rite" incorporated herein by reference.

Figure 3A:
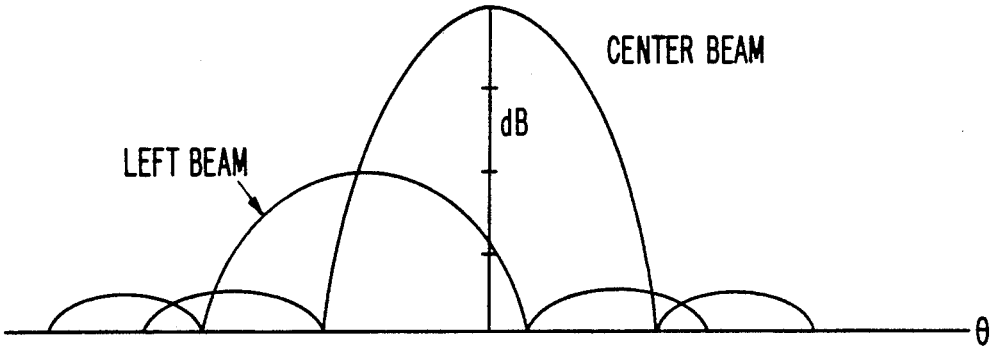
FIG. 3A is a graphical representation of two individual beams of the present invention.
Figure 3B:
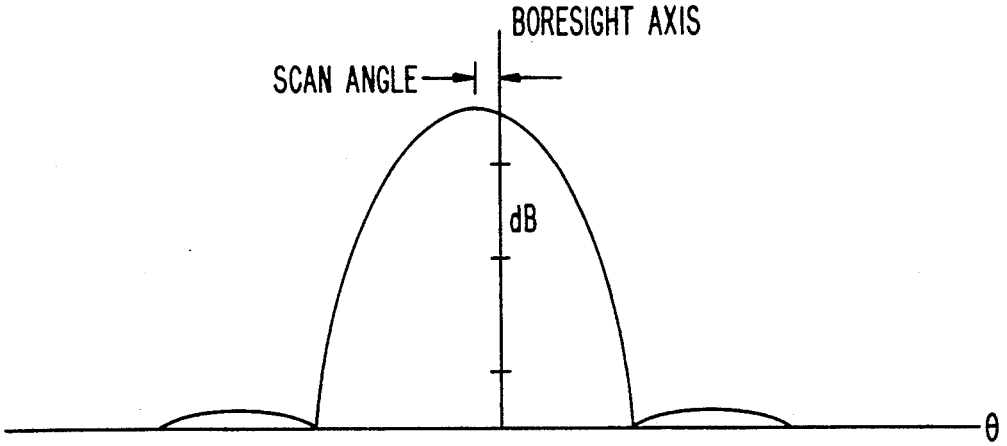
FIG. 3B is a graphical representation of the resultant scanned beam of the present invention formed by the combination of the two beams of FIG. 3A.
Figure 11:
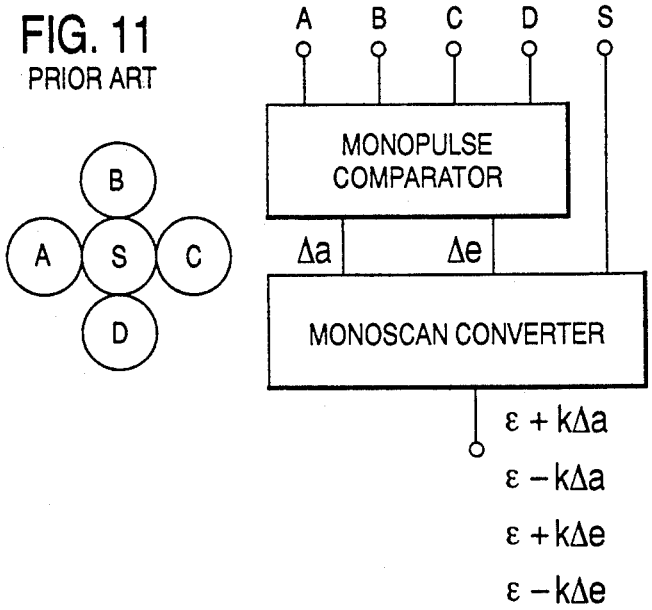
FIG. 11 PRIOR ART
FIG. 11 is a simplified block diagram of a prior art single channel monopulse five element array and feed configuration.
Figure 12:
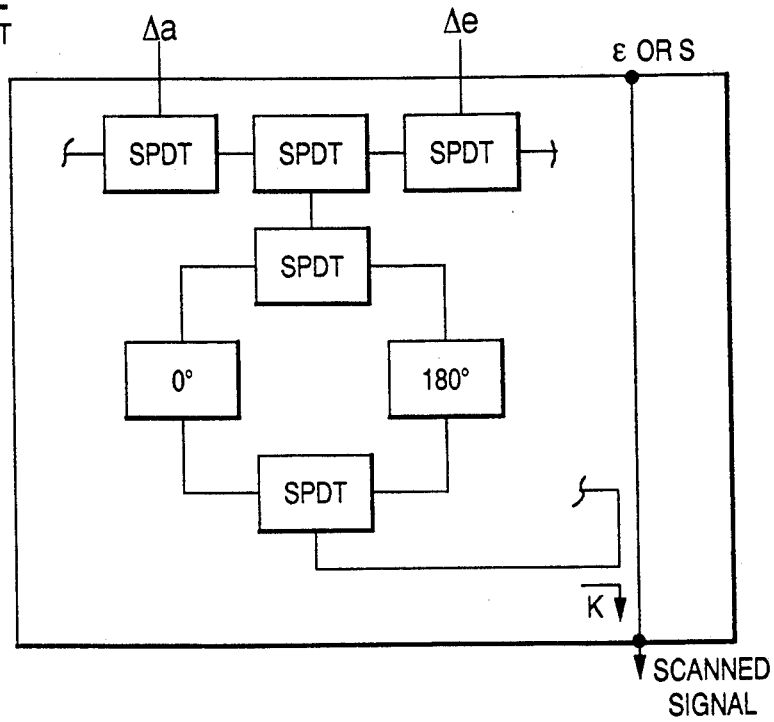
FIG. 12 PRIOR ART
FIG. 12 is a schematic block diagram of a prior art single channel monoscan converter.
Figure 13A:
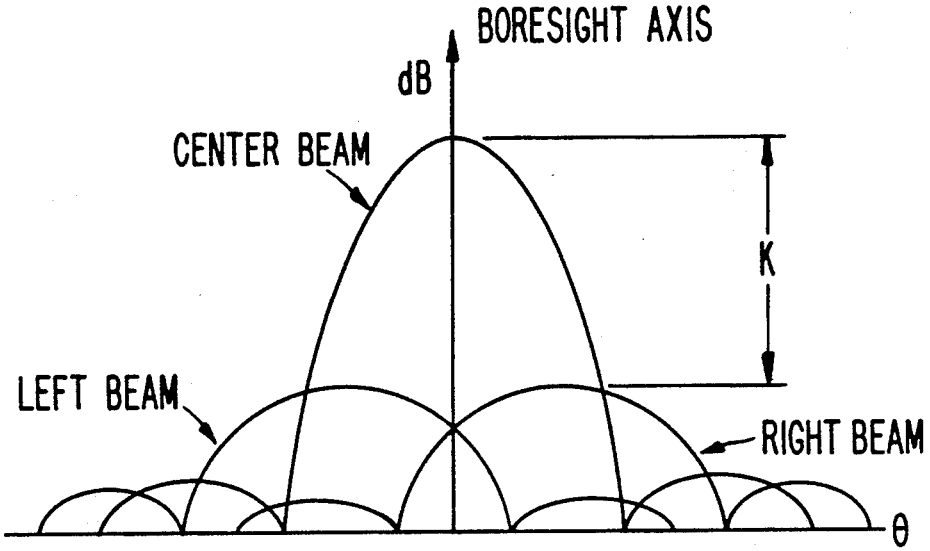
FIG. 13A (PRIOR ART)
FIG. 13A is a graphical representation of individual secondary beams of a prior art single channel monopulse for three feed elements.
Figure 13B:
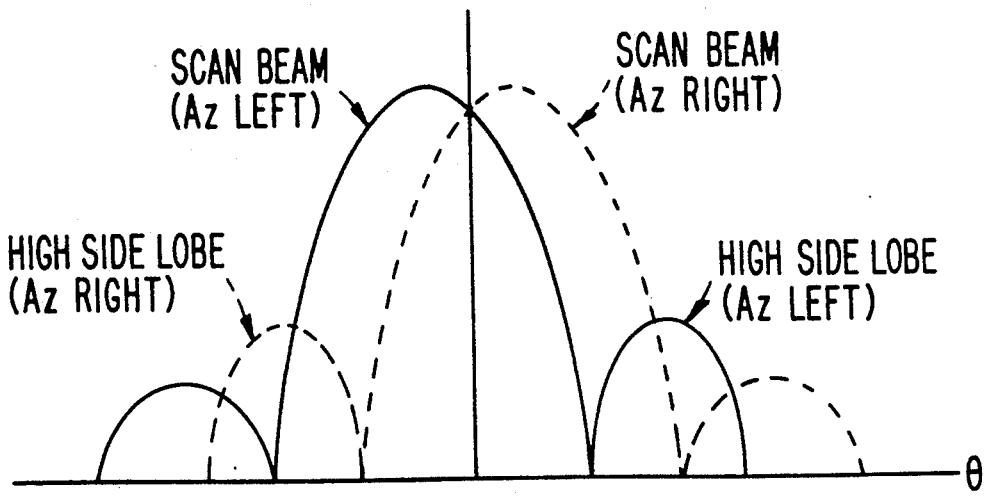
FIG. 13B is a graphical representation of a resultant scanned secondary beam for a prior art single channel monopulse system for three feed elements.
Figure 14:
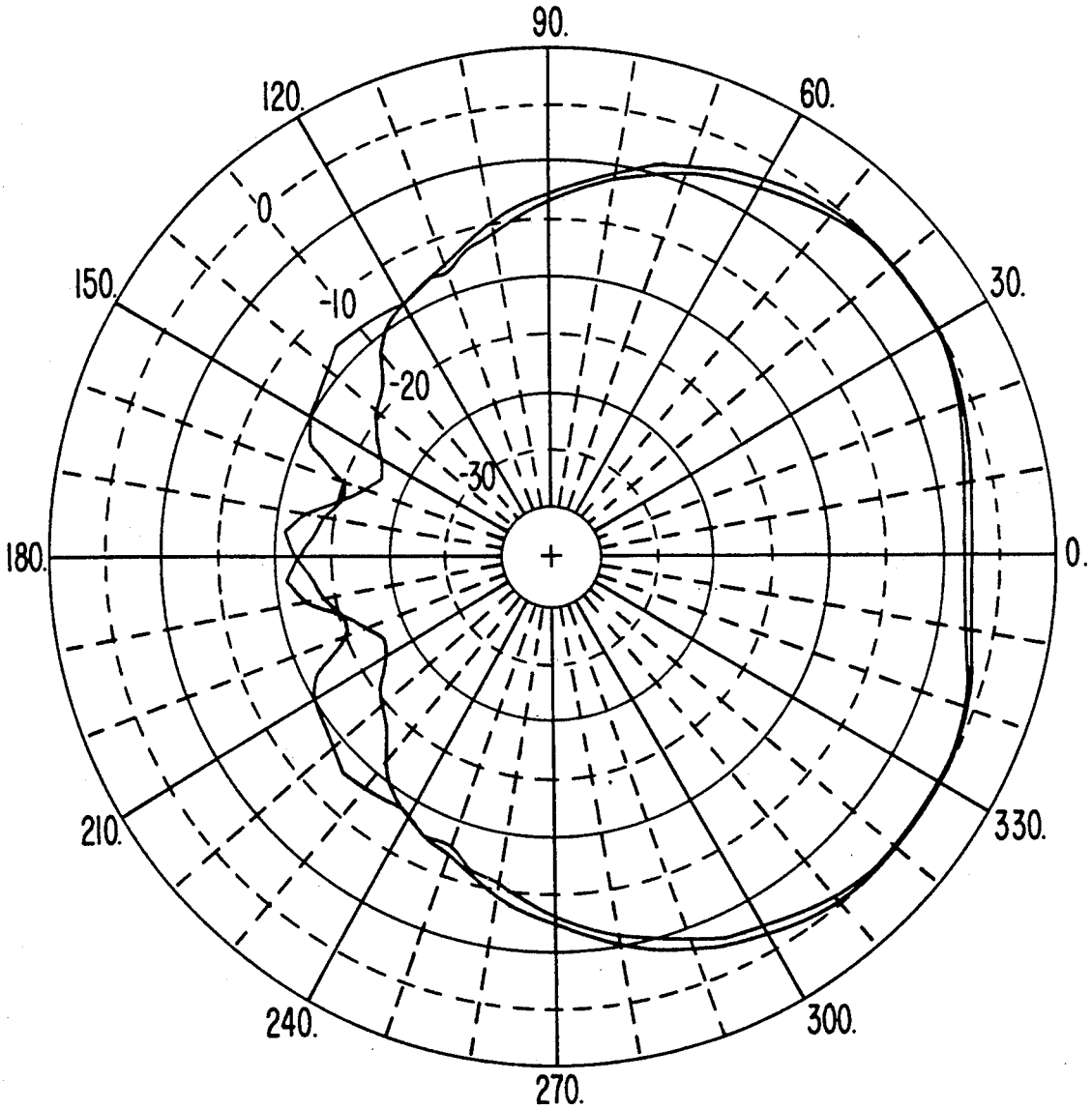
FIG. 14 (PRIOR ART)
FIG. 14 is a graphical representation of the amplitude patterns for two orthogonal planes of a prior art five element feed for single channel monopulse to show symmetry.
Figure 15:
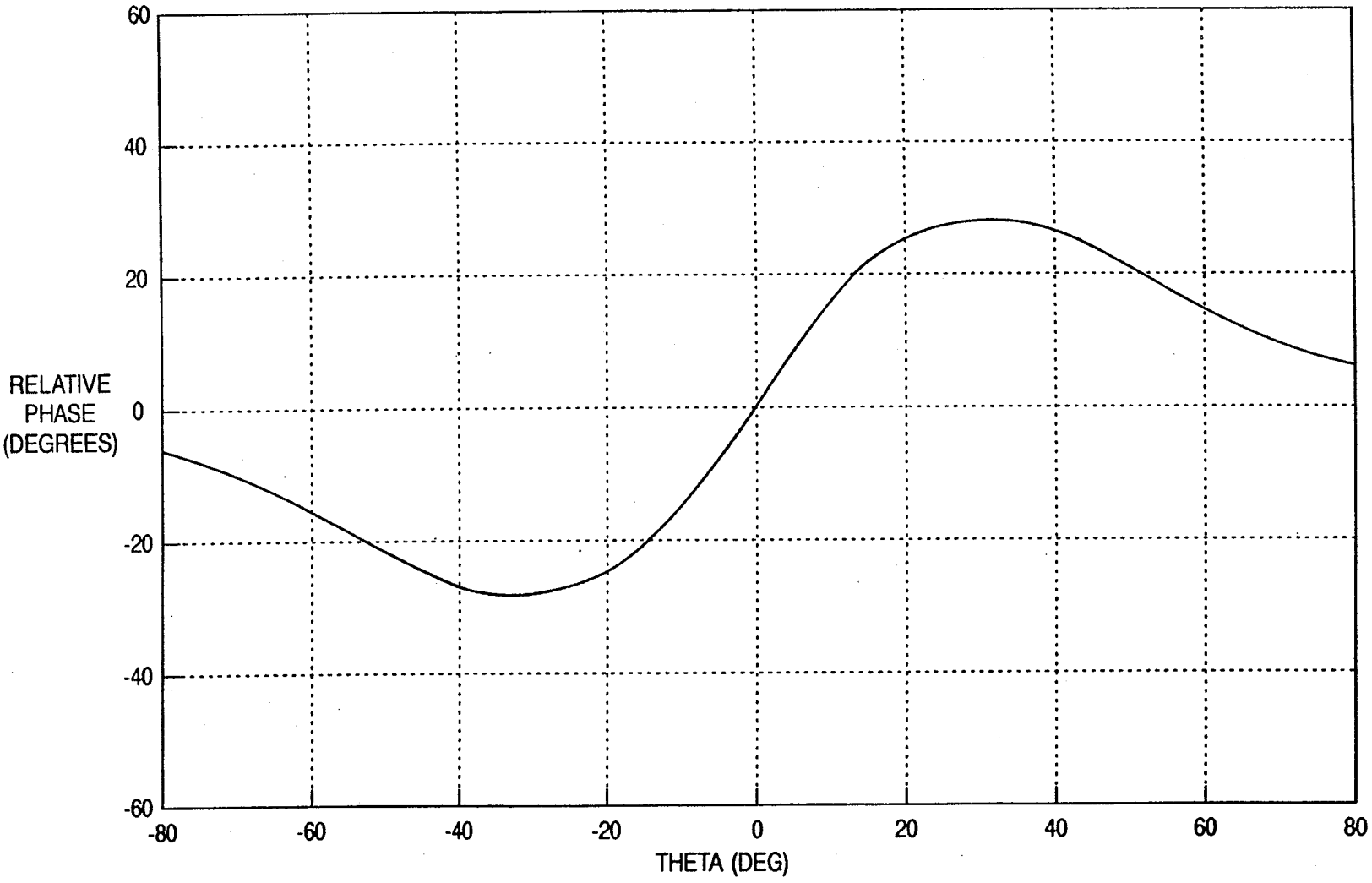
FIG. 15 PRIOR ART
FIG. 15 is a graphical representation of the calculated phase function of a prior art five element feed for single channel monopulse.
Figure 16A:
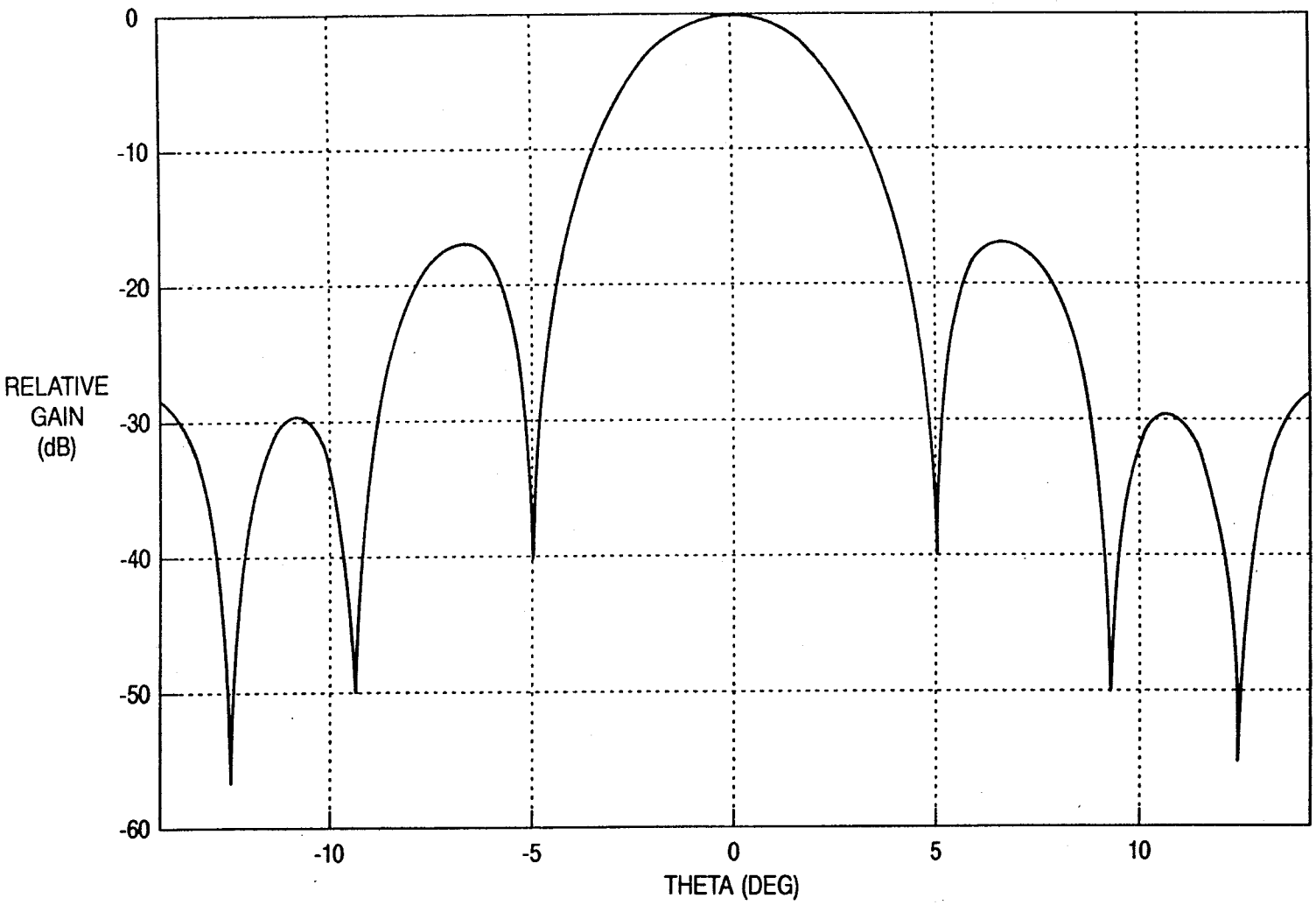
FIG. 16A PRIOR ART
FIG. 16A is a graphical representation of the unscanned plane secondary beam pattern of a 120" reflector antenna using a five element feed of a prior art single channel monopulse system.
Figure 16B:
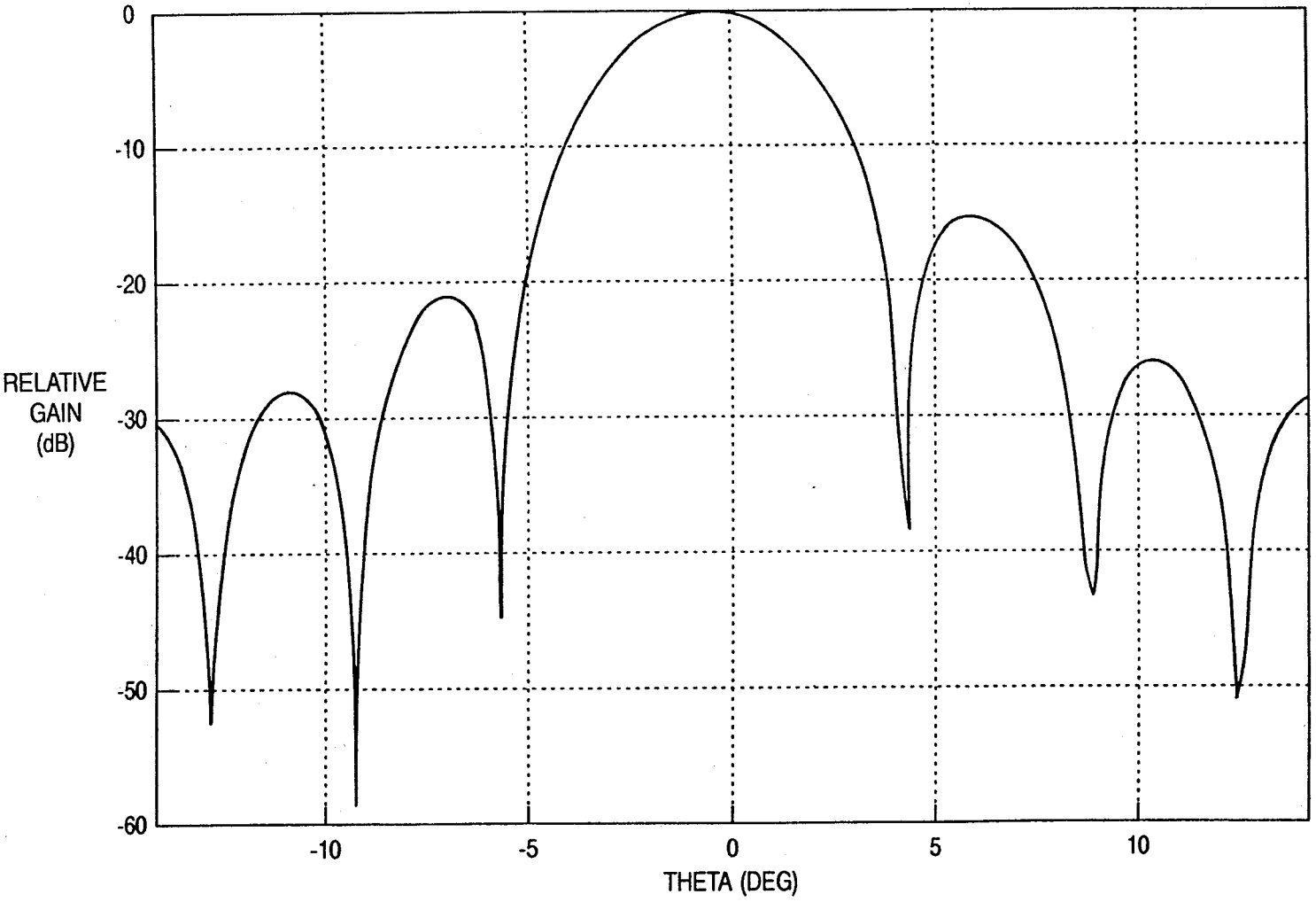
FIG. 16B PRIOR ART
FIG. 16B is a graphical representation of the scanned plane secondary pattern of a 120" reflector using a five element feed of a prior art single channel monopulse system.

According to the present invention, the signal combining circuit comprises an antenna array processor 102 for processing the signals received of the multi-element antenna 101 differently than via SCM systems. In particular, the signal of the central most element, for example, is combined with one of the signals output of one of the other elements and their combined amplitudes applied for steering the antenna to automatically track a target vehicle (FIG. 3A and 3B). Predetermined amplitude weighting is applied, for example, at a directional coupler having an amplitude weighting factor for combining the signals. No monopulse comparator (FIG. 11) is required.

Referring briefly now to FIGS. 2A–2E, there are shown a number of embodiments following the principles of the present invention whereby at least two elements are used for developing an amplitude weighted steering signal whereby the antenna may automatically track a target vehicle by known antenna data processing techniques as represented by signal processor 104. Advantages result in improved side lobes and reduced crosstalk over SCM techniques and the tracking accuracy approximates a full monopulse system.

A mathematical derivation of the principles behind the present invention is followed by a detailed description of the embodiments of FIGS. 2A–2E.

According to the present invention, at least two beams are superpositioned in space. In a simplified case, these two beams, for example, in the azimuth plane (elevation plane) are described as follows:

(a) An on-axis beam is formed by a switched array combination of a center element and two elements in the elevation plane (azimuth plane).

(b) An off-axis beam is formed by two elements in the azimuth plane (elevation plane).

The phasor combination of these two beams in a scanned beam in the azimuth plane. Therefore, the array pattern of the feed is expressed mathematically as follows:

$$E(\text{Theta,Phi}) = [1 + 2*k(1)*\text{Cos}(\text{Pi}*d*\text{Sin}(\text{Phi})) + k(2)*\text{Cos}(2*\text{Pi}*d*\text{Sin}(\text{Theta}))] * EE(\text{Theta,Phi}) + i[k(2)*\text{Sin}(2*\text{Pi}*d*\text{Sin}(\text{Theta}))] * EE(\text{Theta,Phi}) \quad (4)$$

where k(1) is the amplitude coefficient of the evaluation plane elements B & D;

k(2) is the amplitude coefficient of the azimuth plane element; and

EE(Theta,Phi) is the individual element pattern.

If we examine the azimuth plane (Phi=0) and substitute $$Psi=(2*Pi*d*\text{Sin}(Theta)) \quad (5)$$

Equation (4) reduces to $$E(Theta)=[1+2*k(1)+k(2)*\text{Cos}(Psi) + 1*k(2)*\text{Sin}*(Psi)]*EE(Theta) \quad (6)$$

The expression for the amplitude of Equation (4) differs in a significant way from the similar expression for SCM in Equation (1), namely the sine term varying in Theta has been reduced by a factor of two and a cosine term also varying in Theta has been added. Since the cosine function has a peak at Theta equaling zero (on axis) and reduces to zero as Theta goes to 90 degrees, the array coefficients can be chosen such that a desirable amplitude illumination function for the reflector antenna is produced.

The phase distribution is given by $$\begin{aligned} \text{Phase(Theta)} &= \text{Arctan}[Im(E(\text{Theta}))/Re(E(\text{Theta}))] \\ &= \text{Arctan}\ [(k(2)*\text{Sin(Psi)})/\ (1 + 2*k(1) + k(2)*\text{Cos(psi)})] \end{aligned} \quad (7)$$

The phase distribution according to the present invention is very similar to the SCM distribution described above in the Background of the Invention section of the present application as it is directly proportional to a sine function. As shown above, the sinusoidal phase distribution results in the secondary beam being steered off axis.

Figure 4:
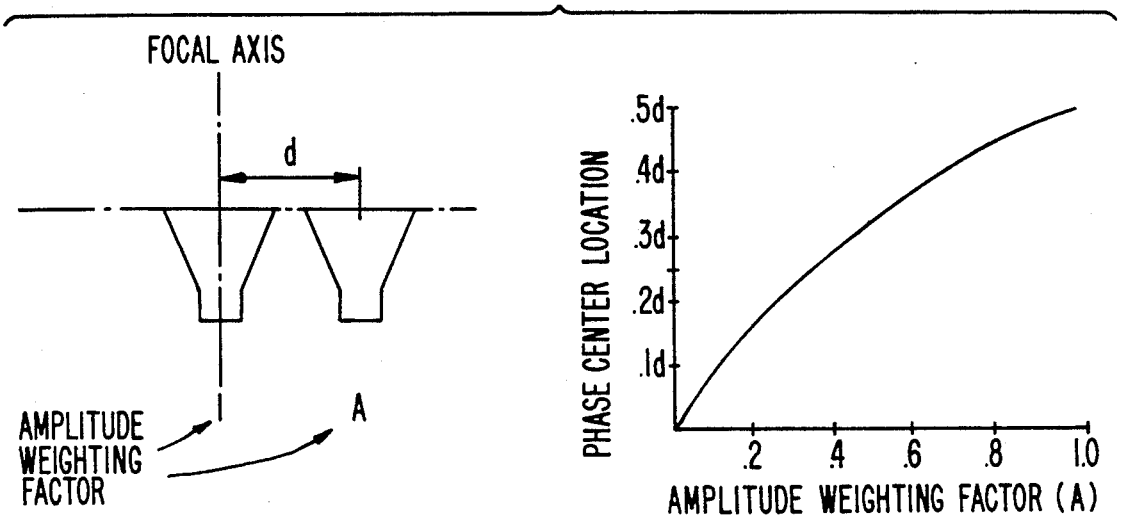
FIG. 4 is a pictorial representation of a simplified two element array and a graph showing the phase-center location of the two element array as a function of a weighting factor A.

An alternate way of explaining the beam steering capability of the present invention is to consider a simplified two element antenna array as shown in FIG. 4. When the focal axis element and the element offset by distance d from that element are excited with signals of equal amplitude, the phase-center lies on the aperture of the array plane, equidistant between the two elements. As the amplitude excitation of one of the elements is reduced relative to the other, the phase-center moves along the aperture plane toward the stronger excited element as shown in FIG. 4. Therefore, the beam phase-center may be positioned to any desired position between the two elements as the amplitude excitations of the two elements are varied. If one of the elements is placed on the focal axis of a reflector antenna, the feed phase-center of the two element array is then off-axis which results in a steered beam. This amplitude adjustment relationship A as defined here and throughout the specification and claims will be henceforth referred to as an amplitude weighting factor. Parameters contributing to an overall amplitude weighting factor include amplitude coefficients of antenna elements, coupling factors of directional couplers, and circuit losses.

Figure 5:
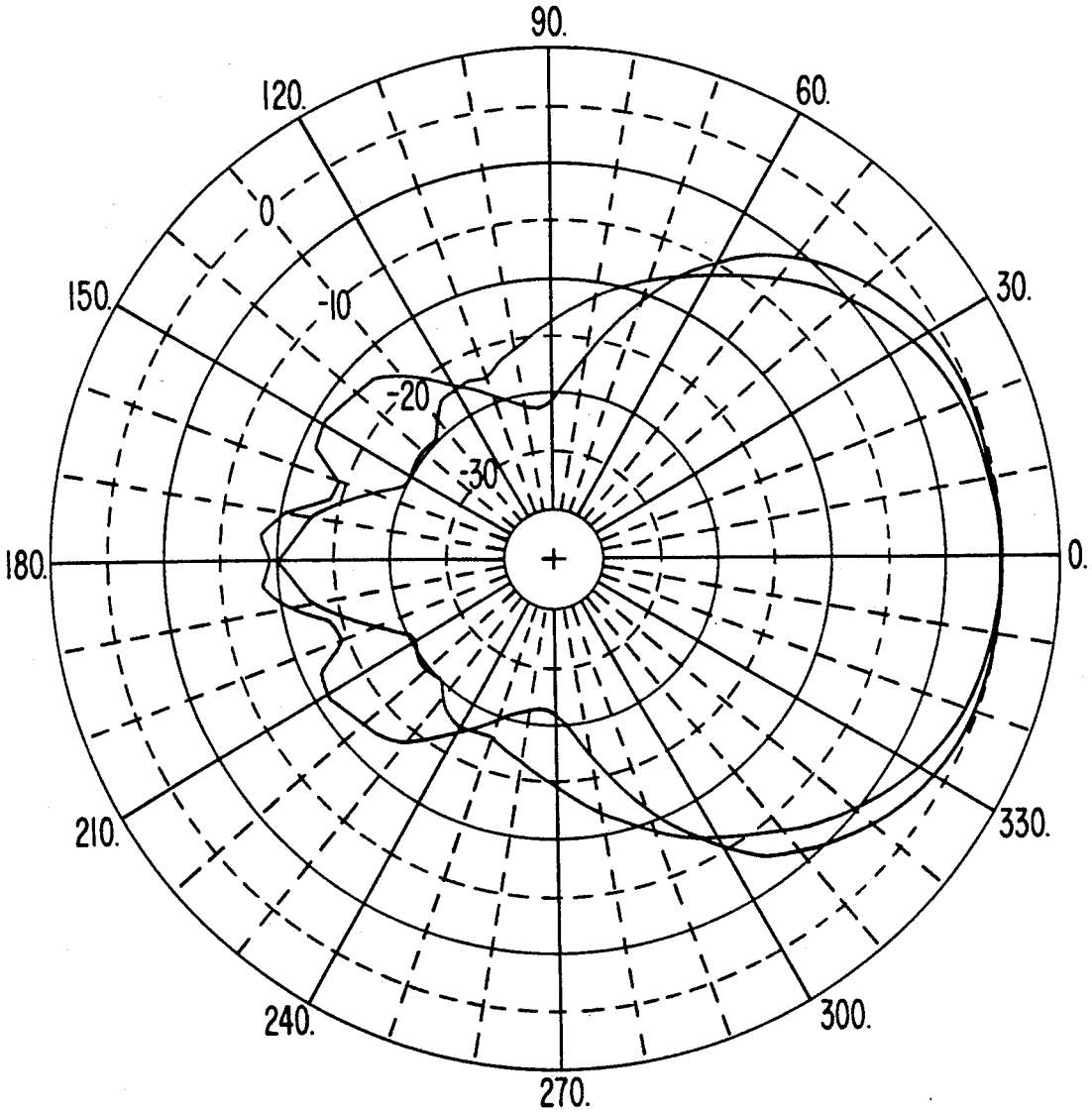
FIG. 5 is a graphical representation of the amplitude patterns for two orthogonal planes of a five element feed according to the present invention to show symmetry.
Figure 6:
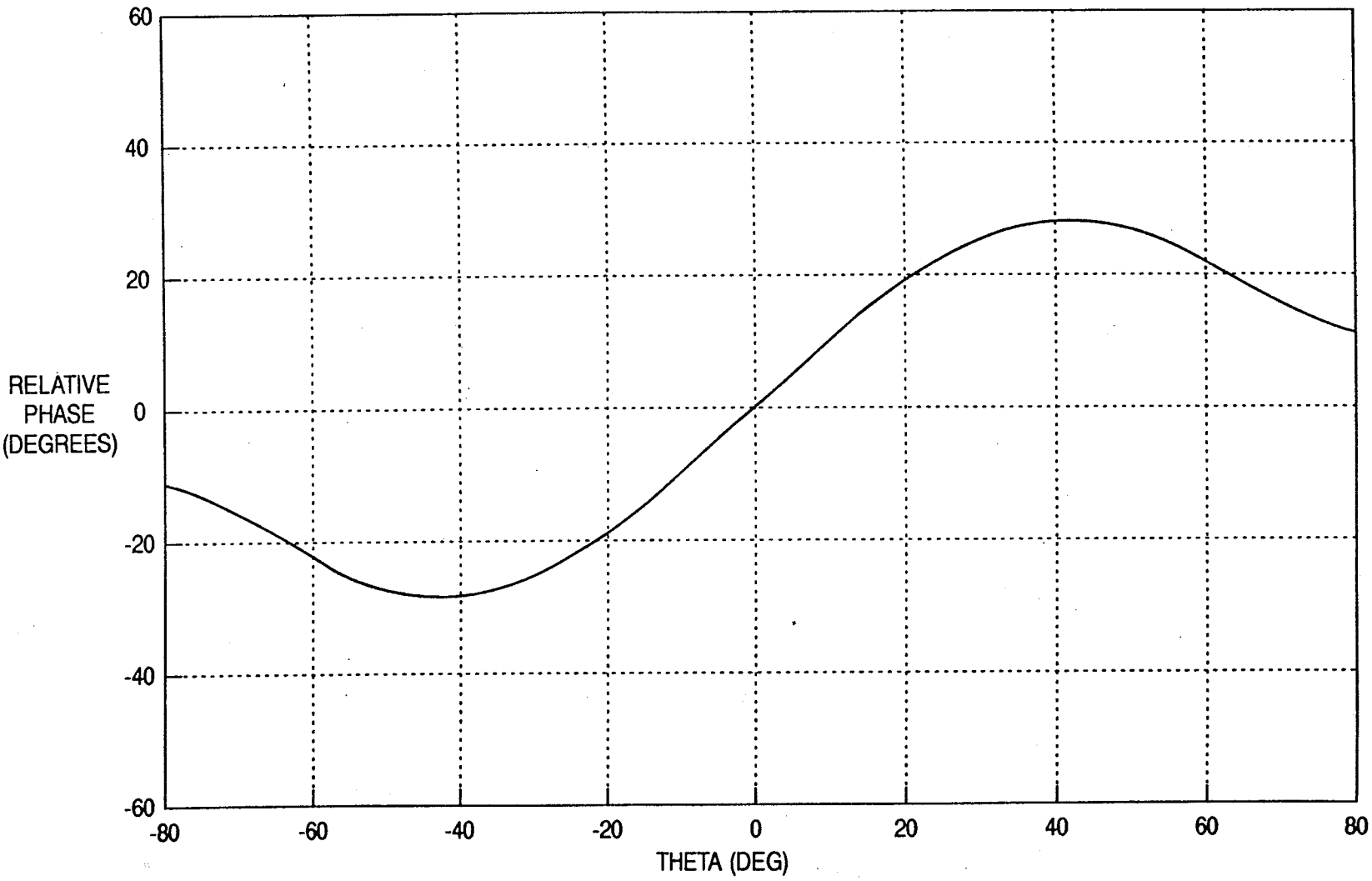
FIG. 6 is a graphical representation of the calculated phase function of a five element feed according to the present invention.
Figure 7A:
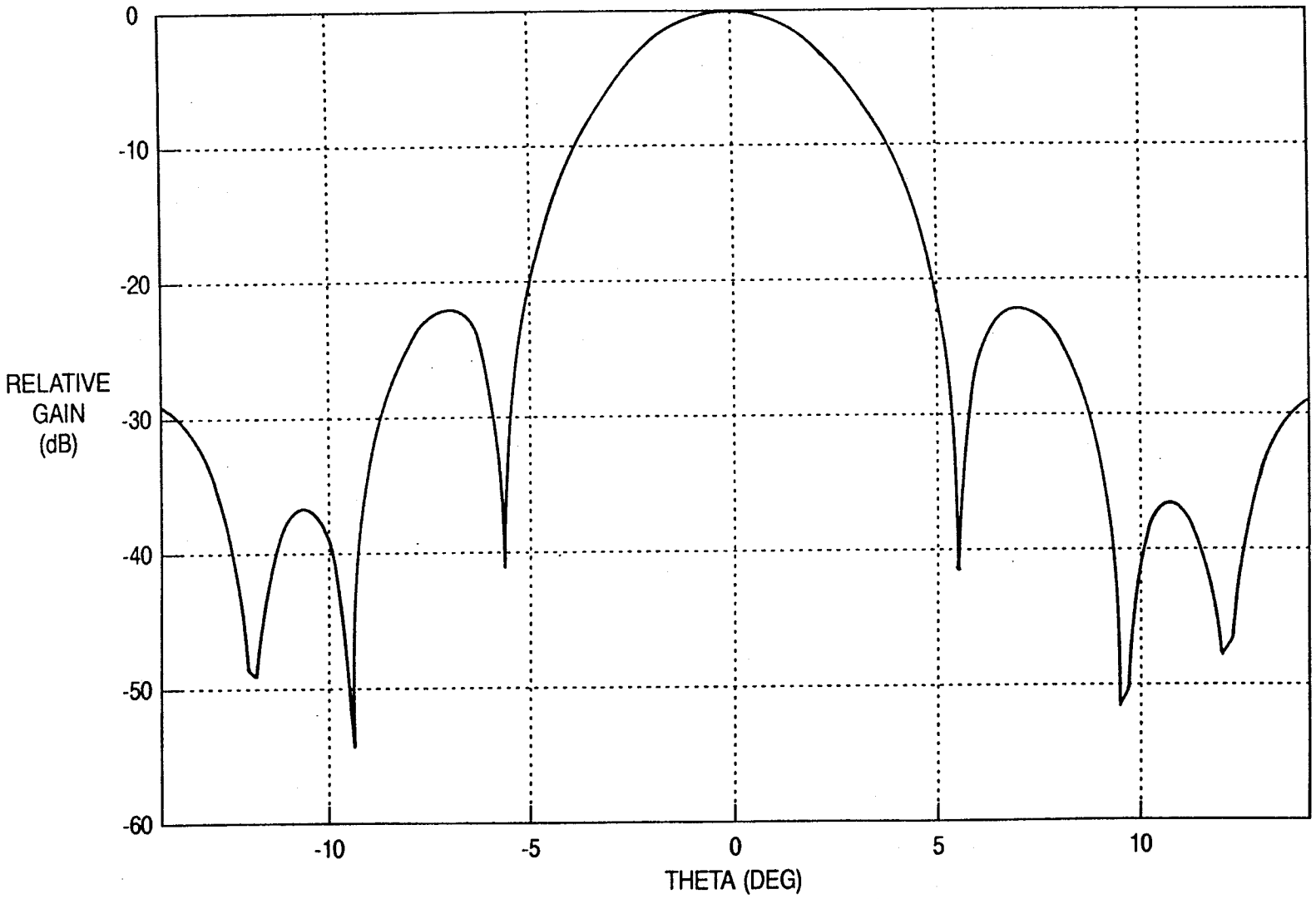
FIG. 7A is a graphical representation of the unscanned plane secondary beam pattern of a 120" reflector antenna using a five element feed according to the present invention.
Figure 7B:
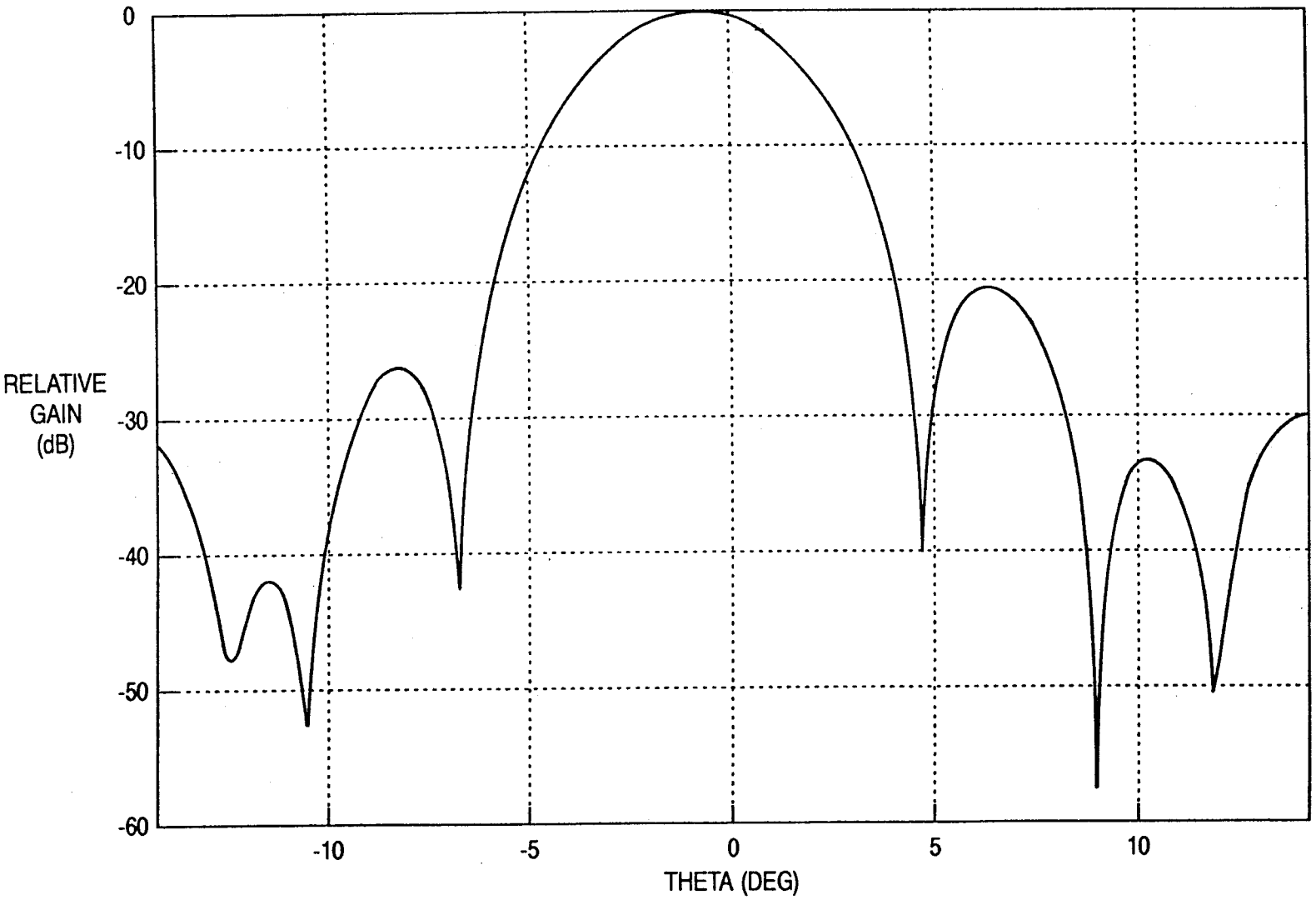
FIG. 7B is a graphical representation of the scanned plane secondary beam pattern of a 120" reflector antenna using a five element feed according to the present invention.
Figure 8:
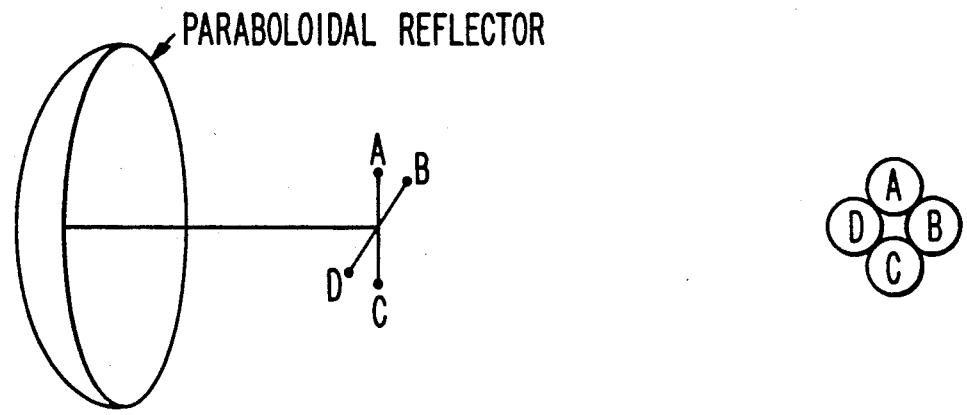
FIG. 8 (PRIOR ART)
FIG. 8 is a pictorial representation of a prior art sequential lobing feed configuration of a reflector antenna.
Figure 9:
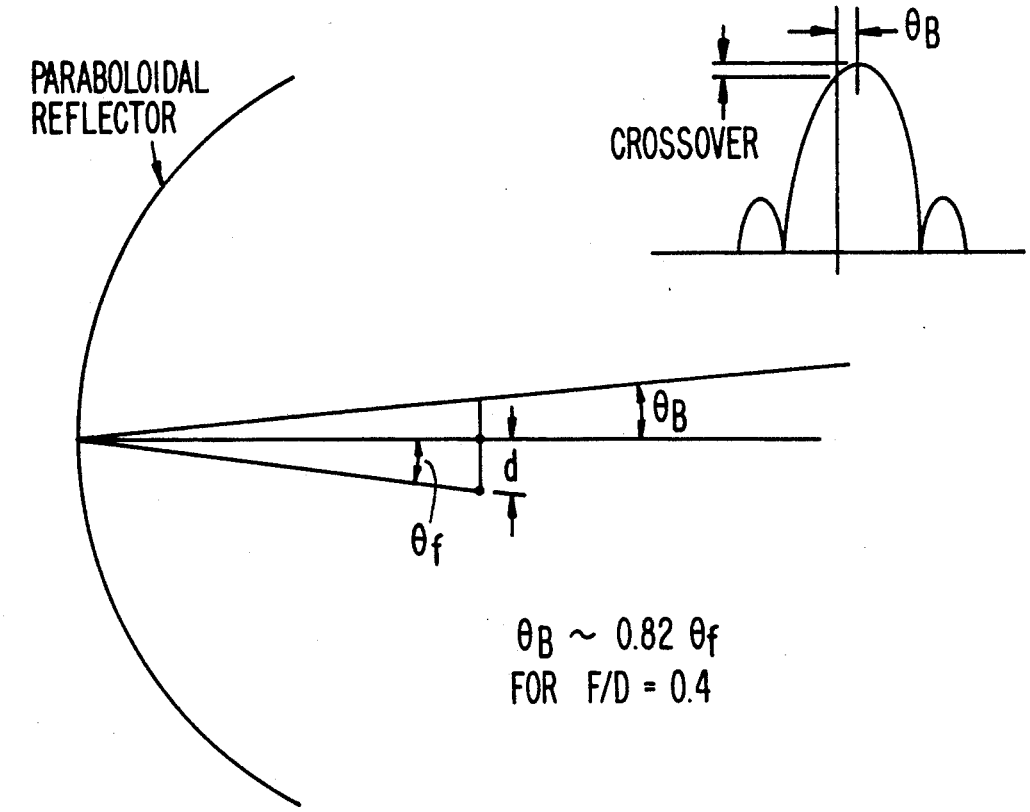
FIG. 9 (PRIOR ART)
FIG. 9 is an offset beam generated by an offset feed from the focal axis of a prior art reflector antenna.
Figure 10:
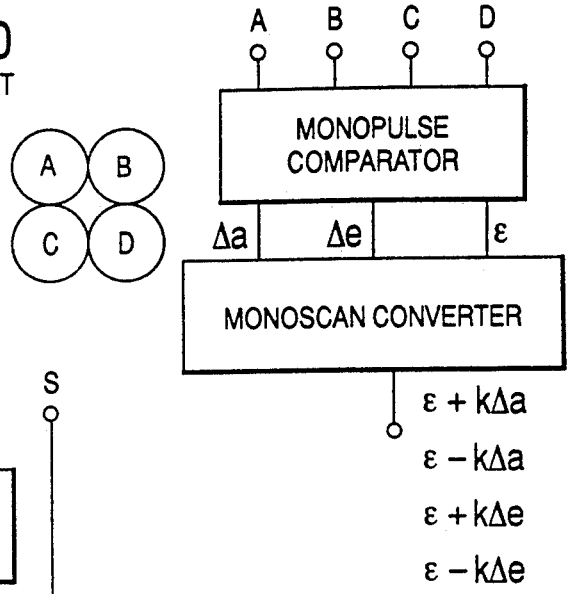
FIG. 10 PRIOR ART
FIG. 10 is a simplified block diagram of a prior art single channel monopulse four element array and feed configuration.

The amplitude patterns for two orthogonal planes of a five element feed according to the present invention are shown in FIG. 5. The calculated phase function of a five element feed according to the present invention is shown in FIG. 6. The unscanned and scanned plane secondary beams of a 120" reflector antenna is shown in FIGS. 7A and 7B, respectively. The peak side lobes are better than 20 dB below the peak of the beam in both the unscanned and the scanned pulse.

The crosstalk exhibited by SCM is typically 15 to 20 dB below the desired tracking error signal and consists of contributions from mutual coupling, cross-polarization coupling and mismatch. The SCM crosstalk is generated by the parasitic anti-phase excitation of the orthogonal channel elements. The anti-phase excitation as described above is primarily due to magic tee apparatus used in the monopulse comparator network. The feed configuration according to the present invention eliminates the anti-phase condition such that any mutual coupling of VSWR related excitation of elements in the orthogonal plane does not generate an offset or steered beam and therefore crosstalk is effectively reduced.

The only disadvantage of the present invention is it sensitivity to phase differences in the combining networks. A phase differential between the feed elements leads to a beam squint of the primary pattern of the antenna array.

It should be considered during the design of a system for a particular application that, in order to follow the principles of the present invention, phase differences ought to be maintained to less than approximately 20 degrees. Phase adjustment apparatus (not shown) may be implemented at any convenient point in the apparatus of FIG. 2A–2E for brining the phase differences within tolerable limits.

It has already been described how coupling factors k are associated with determining an overall amplitude weighting factor for a signal combining circuit according to the present invention. In fact, amplitude weighting may be determined in any convenient manner. For example, variable attenuation apparatus controlled by control signals 230–630 may be implemented by any convenient location in the apparatus of FIGS. 2A–2E whereby an amplitude weighting of any signal output of antenna array 291–601 may be achieved.

The advantages of tracking in accordance with the present invention can be summarized as follows:

(a) Electronic switching circuits allow flexibility in scan rate which feature overcomes the problem with tracking spin-stabilized vehicle;
(b) The data channel can be configured independent from the tracking channel eliminating scan modulation on the data;
(c) There are no mechanical rotating devices;
(d) High reliability;
(e) Cost effectiveness;
(f) Amplitude weighting of the feed elements results in low side lobes in the unscanned and scanned planes;
(g) Crosstalk is effectively minimized;
(h) Overall tracking accuracy is superior to SCM, approaching full monopulse; and
(i) Broadband operation.

Now referring to FIGS. 2A–2E, different embodiments of the present invention are shown in particular detail without violating the principles of the present invention wherein an output of a first element of a multi-element antenna is switchably combined in amplitude with another selected element offset from the first element of the array. The resultant amplitude weighted signal is processed to steer the antenna for automatically tracking a target.

Figure 2A:
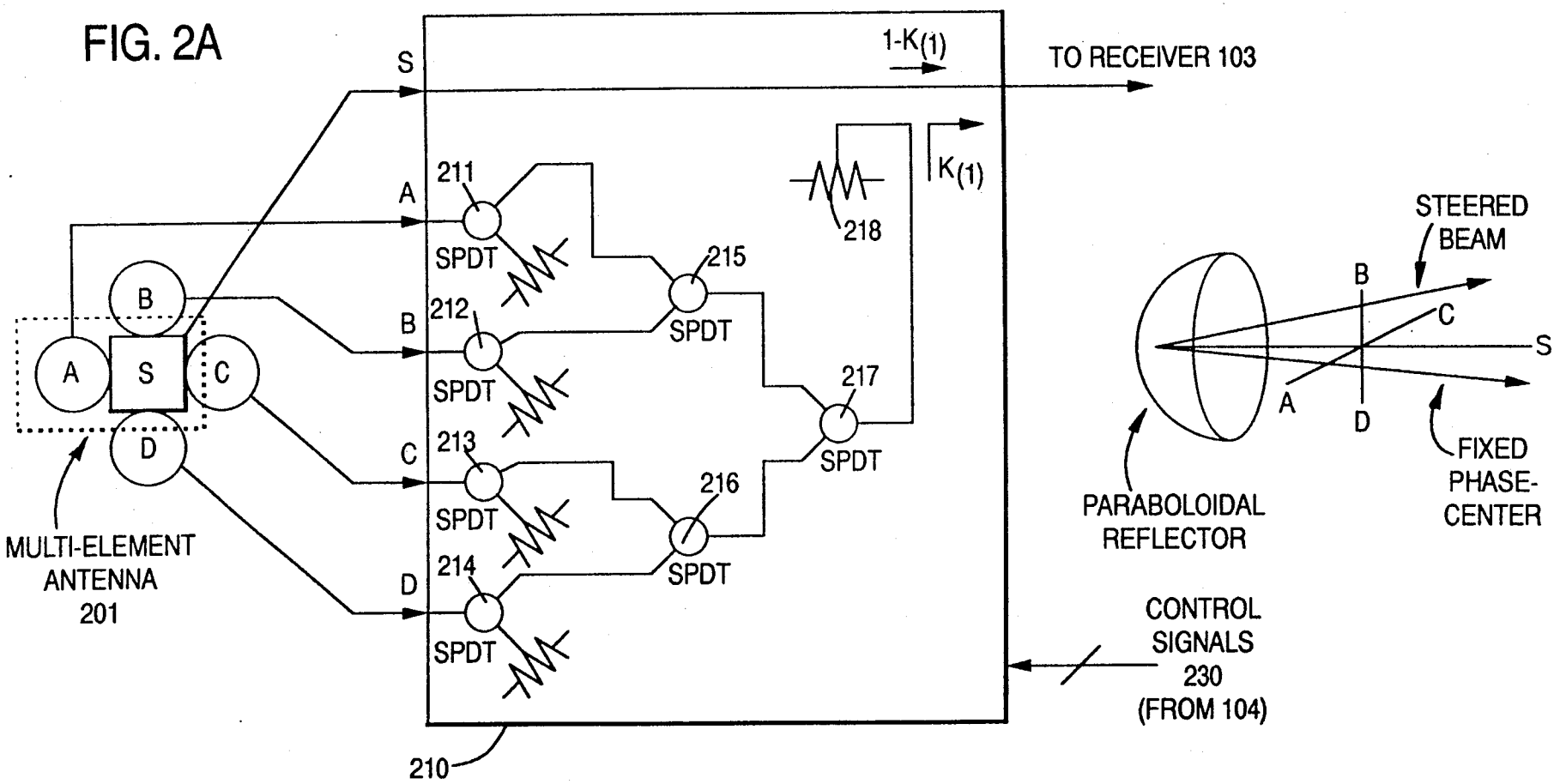
FIG. 2A is a schematic block diagram of one such embodiment of the multi-element antenna of the antenna array processor shown in FIG. 1. This embodiment is for a five element antenna array configuration similar to that shown.

Referring first to FIG. 2A, a five element antenna is shown in a typical configuration, elements A and C being in the azimuth plane and elements B and D in the elevation plane with element S being a central most element. Element array 201 is coupled to a combining network 210 under control of control signals 230 output of data processing system 104 of FIG. 1.

Single-pole double-throw (SPDT) diode switch 211 is coupled to element A, diode switch 212 to element B, diode switch 213 to element C and diode switch 214 to element D. Central element S is connected to directional coupler 218 for coupling with the selected output of diode switching network 211–217. Via control signals 230, one output of A, B, C, or D is selected for combining at directional coupler 218 with central element. Consequently, control signals 230 may be transmitted over seven separate leads in parallel (or over three leads with the application of a digital signal decoder known in the art but not shown). Furthermore, the control signals may be transmitted at a variable data rate to vary the rate or scanning of elements.

In the configuration shown, coupling factors $k_{(1)}$ and $1-k_{(1)}$ for amplitude weighting determine beam steering. These coupling factors primarily determine the resultant amplitude weighting factor of the embodiment of FIG. 2A, however, in alternative embodiments there may exist other contributions to a resultant amplitude weighting factor. There is no array combining in the orthogonal plane in this embodiment for side lobe control. The antenna beam is sequentially lobed by means of the diode switching network 211–217. Four beam positions are provided which may be denoted azimuth right, azimuth left, elevation up, and elevation down via the seven single-pole double-throw switches shown. (Switching network 211–214 may likewise comprise one four-pole single-throw internally loaded switch.) The beams are denoted as follows: azimuth right, $S+k_{(1)}A$; elevation down, $S+k_{(1)}B$; azimuth left, $S+k_{(1)}C$; and elevation up, $S+k_{(1)}D$.

Figure 2B:
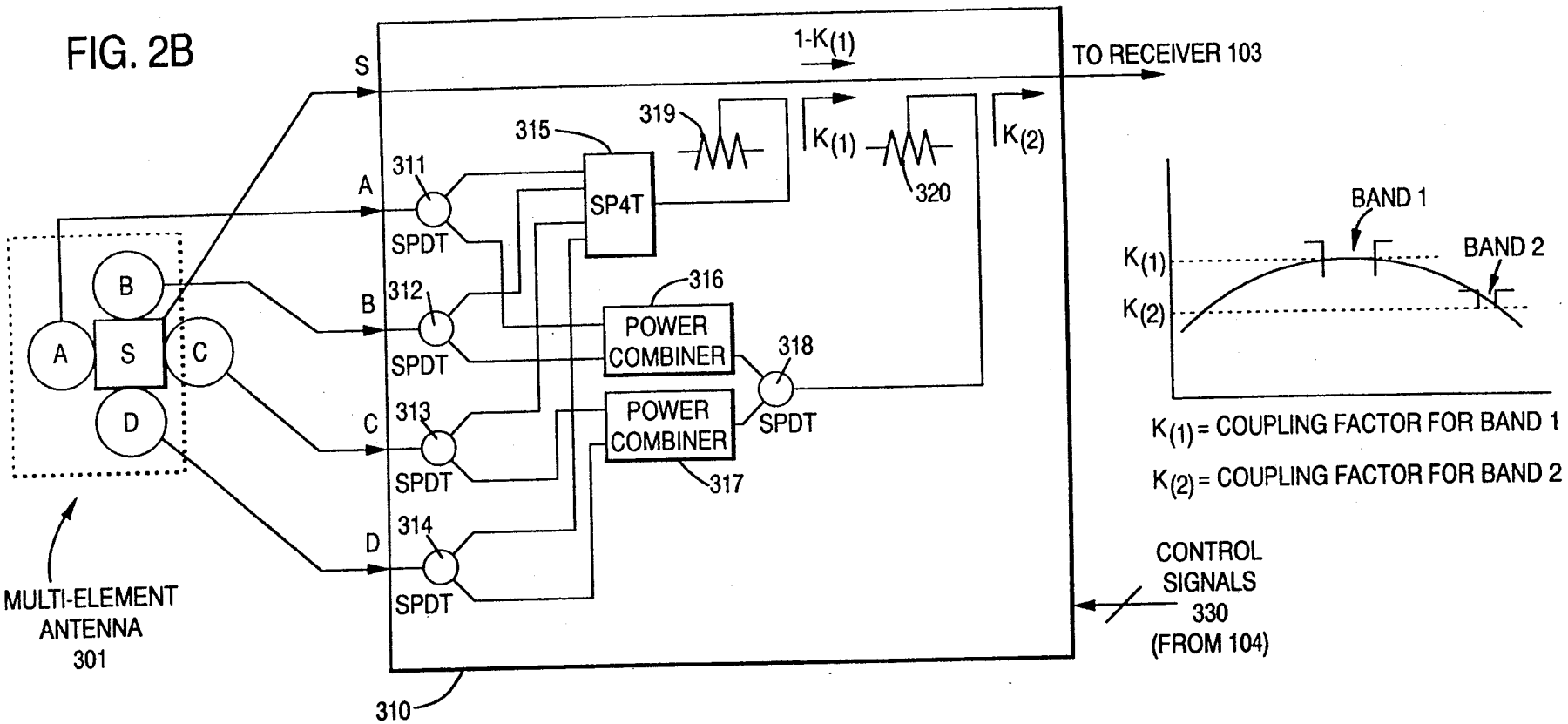
FIG. 2B is a schematic block diagram of another such embodiment of the antenna array processor shown in FIG. 1. This embodiment is for the five element antenna array configuration similar to that shown.

Referring now to FIG. 2B, a more complex switching network 310 is provided for combining outputs of the multi-element antenna array 301. Element A is coupled to SPDT diode switch 311, element B to diode switch 312, element C to diode switch 313 and element D to diode switch 314. Power combiners 316 and 317 are used for combining selected outputs of SPDT diode switches 311 and 312 and diode switches 313 and 314 respectively. The selected outputs of power combiners 316 or 317 are coupled via SPDT diode switch 318 to directional coupler 320.

Also, a single-pole four-throw switch 315 receives a selected output of diode switches 311–314 which is coupled to the main central element feed at directional coupler 319. An amplitude constant $k_{(1)}$ associated with directional coupler 319 determines beam steering. The amplitude constant $k_{(2)}$ associated with directional coupler 320 determines side lobe suppression in the unscanned beam, i.e. the beam orthogonal to the beam plane. As shown, this more complex embodiment requires, for example, five single-pole double-throw pin diode switches, one four-pole single-throw switch and two power combiners. However, this more complex embodiment permits effective control of side lobes and beam squint versus frequency. Coupling factor coefficients $k_{(1)}$ and $k_{(2)}$ are selected to be frequency dependent for this purpose as shown by the graph of coupling factors $k_{(1)}$ and $k_{(2)}$ for two frequency bands—band 2 and 2—shown in the graphical portion of FIG. 2B where $k_{(1)}$ is the coupling value for band 1 and $k_{(2)}$ is the coupling value for band 2.

Figure 2C:
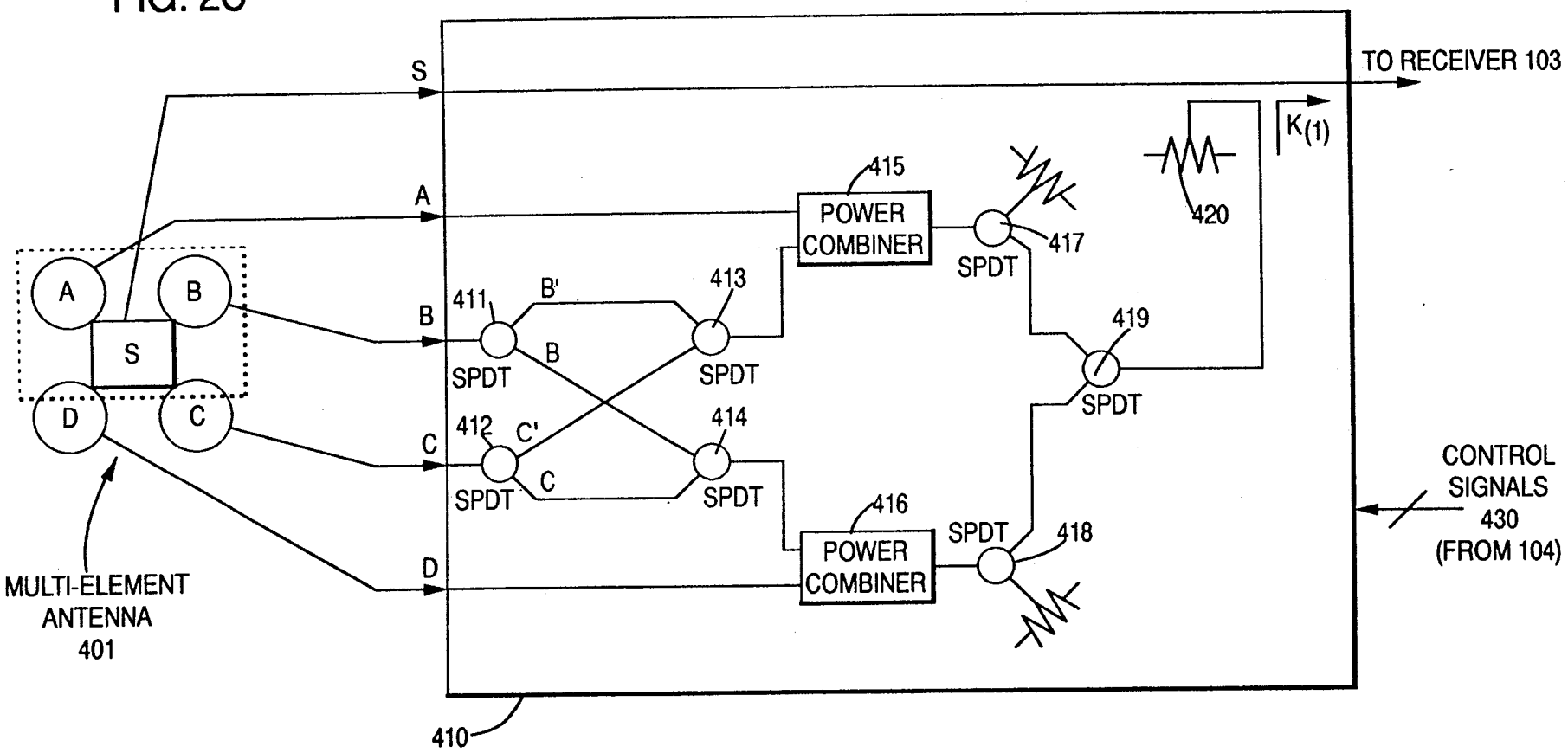
FIG. 2C is a schematic block diagram of another such embodiment of the antenna array processor shown in FIG. 1. This embodiment is for a five element antenna array configuration different from those of FIGS. 2A and 2B and similar to that shown.

Referring now to FIG. 2C, yet another embodiment of the present invention is shown in which the diode switching network involves a criss-cross pattern of four-single pole double-throw diode switches 411–414 for generating diagonal planar signal combinations for elevation and azimuth. As before, the constant $k_{(1)}$ determines beam steering. However, in this embodiment where elements A and B lie in a horizontal plane above the central element S, the elevation down beam is represented by $S+k_{(1)}*(A+B)$. The other resulting beams may be represented as follows: azimuth left, $S+k_{(1)}*(A+C)$; azimuth right, $S+k_{(1)}*(B+D)$; and elevation up, $S+k_{(1)}*(C+D)$.

At power combiner 415, A is combined with B or C while at power combiner 416, element D is combined with elements B or C. Diode switch 419 selects among A+B, A+C, B+D and C+D as indicated above for combining with central elements at coupler 420. Diode switches 417 and 418 are used, for example, to permit signal C+D to pass and to block signals output from combiner 415. This also provides an additional layer of isolation from the selected path output of diode switch 419.

Figure 2D:
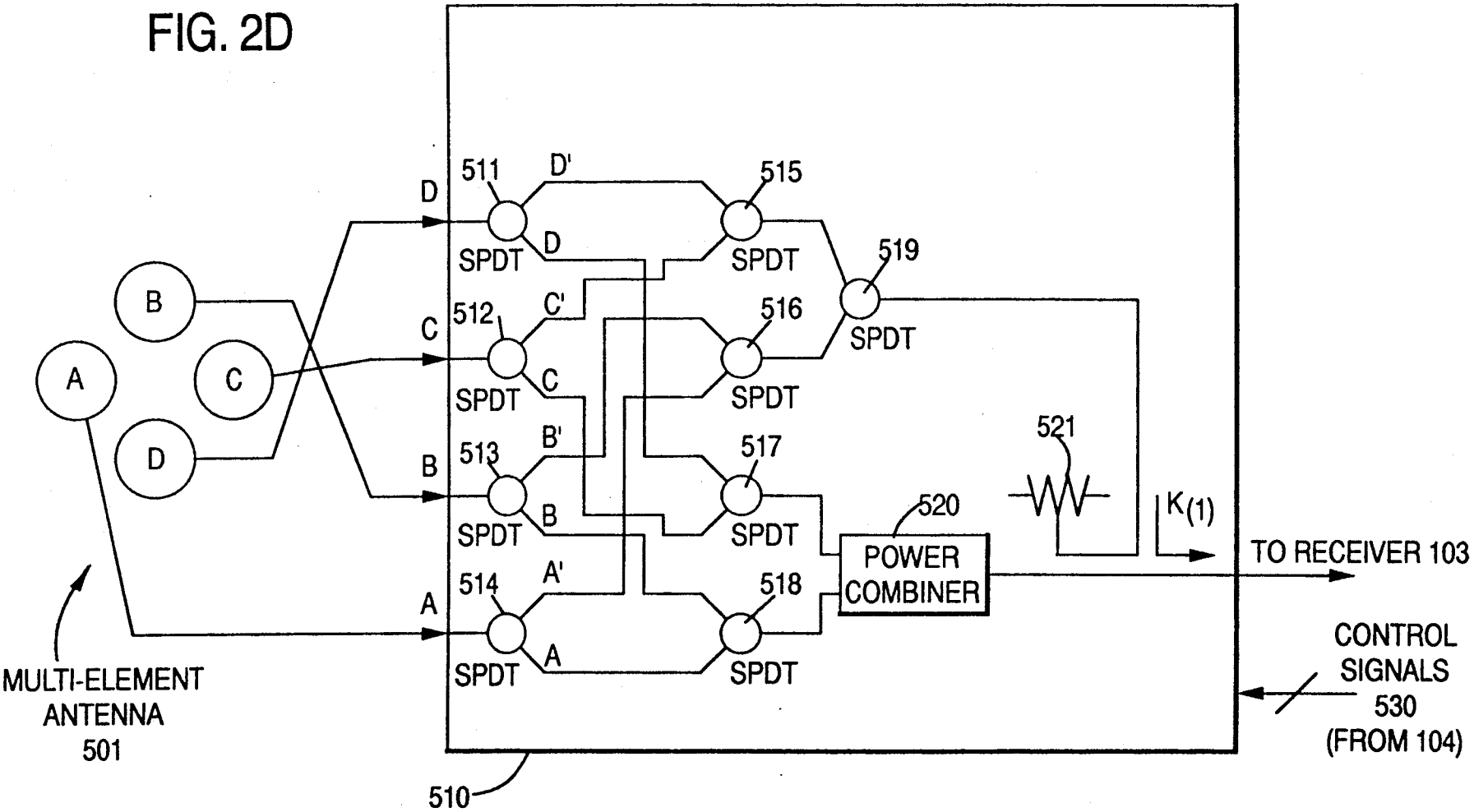
FIG. 2D is a schematic block diagram of another such embodiment of the antenna array processor shown in FIG. 1. This embodiment is for a four element antenna array configuration similar to that shown.

Referring now to FIg. 2D, there is shown a four element array not involving a central element S. Any one of elements A, B, C or D may be combined with selected pairs of elements via the switching network 511–519, power combiner 520 for combining selected pairs of elements and directional coupler 521 for coupling the selected pair with a selected one of the elements. For this embodiment, the beams are selected as follows where X equals 1/(square root of 2):

elevation down beam—$X*(A+C)+k_{(1)}B$;
elevation up beam—$X*(A+C)+k_{(1)}D$;
azimuth left beam—$X*(B+D)+k_{(1)}C$; and
azimuth right beam—$X*(B+D)+k_{(1)}A$.

Figure 2E:
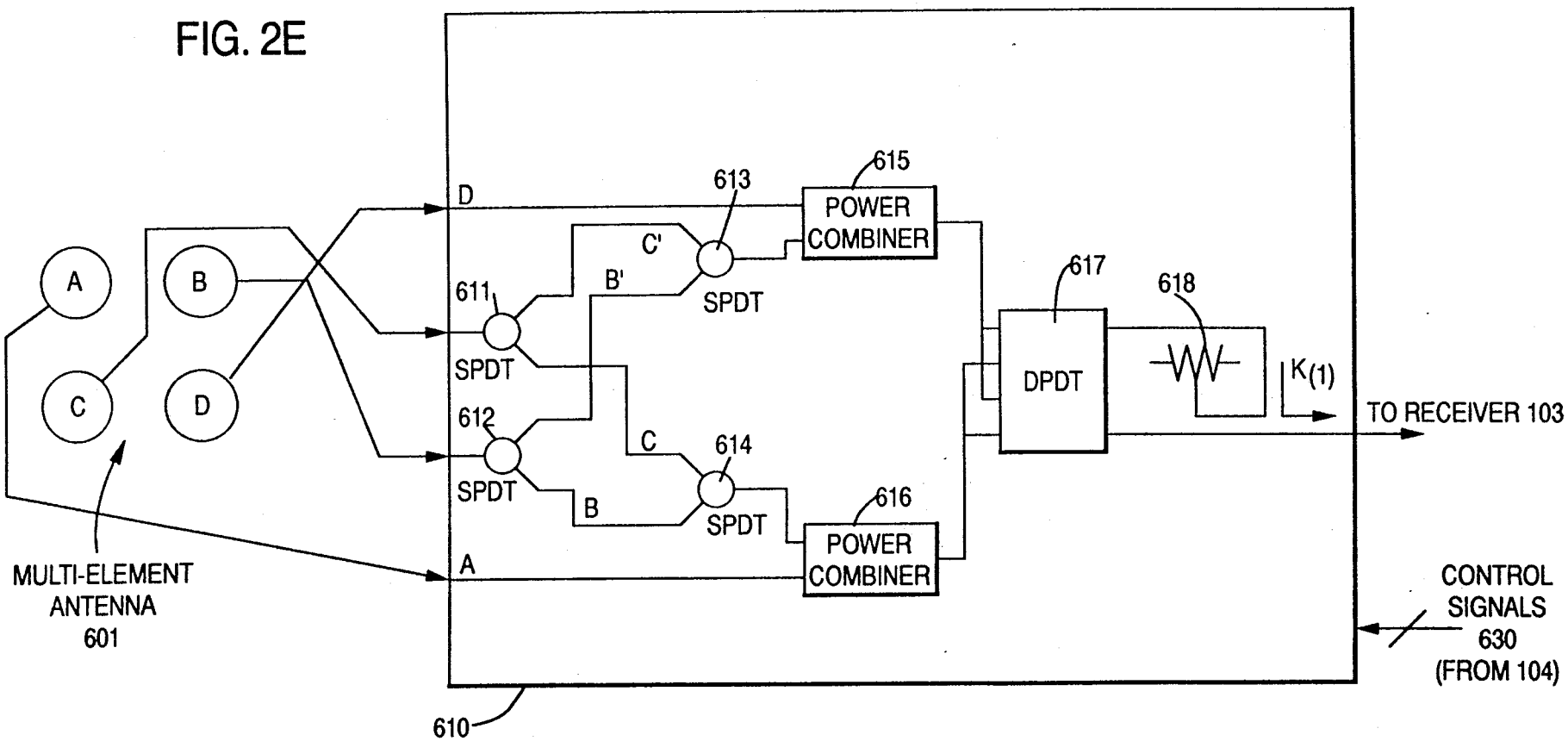
FIG. 2E is a schematic block diagram of another such embodiment of the antenna array processor shown in FIG. 1. This embodiment is for a four element antenna array configuration similar to that shown.

Referring now to FIG. 2E, the antenna elements are arranged such that elements (A and B) and (C and D) are horizontal to one another. Now pairs of elements are combined with other pairs of elements at coupler 618 via double-pole double-throw switch 617. Consequently, the beams are derived as follows where again X is equal to 1/(square root of 2):

elevation down—$X*(A+B)+k_{(1)}(C+D)$;
azimuth right—$X*(A+C)+k_{(1)}(B+D)$;
elevation up—$X*(C+D)+k_{(1)}(A+B)$; and
azimuth left—$X*(B+D)+k_{(1)}(A+C)$.

Thus, according to each of the embodiments of FIGS. 2A–2E, signals of elements are combined to provide an amplitude weighted steering beam signal for automatic tracking of a target in accordance with the principles of the present invention. Yet other switching network configurations for use with different antenna element configurations for different applications may come to mind to one of skill in the art in view of these exemplary embodiments. For example, the number of elements of the array may be increased to twelve, complicating the switching network within the principles of the present invention which is only limited by the scope of the claims which follows.

We claim:

1. Antenna array processor apparatus for automatically tracking a target comprising multiple antenna elements of a multi-element antenna feed, the elements having parallel-planar apertures, a signal switching means coupled to the multiple antenna elements for selecting from a plurality of signals of the multiple antenna elements and a signal coupler for coupling a selected signal of one of the plurality of antenna element signals with another signal of the multi-element antenna feed to produce an antenna beam steering signal.

2. The antenna array processor apparatus as in claim 1 wherein the coupled signal is in-phase with the other signal to which it is coupled.

3. The antenna array processor apparatus as in claim 2 wherein the said coupling results in an amplitude weighted signal for antenna beam steering.

4. The antenna array processor apparatus as in claim 2 wherein said multiple antenna elements include four such elements arranged in the form of a cross with a top most element and a bottom most element positioned along a vertical axis and a right most element and a left most element positioned along a horizontal axis.

5. The antenna array processor apparatus as in claim 4 wherein four selected beams are provided at the output of the signal coupler such that each beam is the combination of a selected element signal and a summation signal of a selected pair of element signals.

6. The antenna array processor apparatus as in claim 4 wherein the multiple antenna elements further include a fifth central element.

7. The antenna array processor apparatus as in claim 6 wherein four selected beams result such that each beam is an amplitude weighted combination of a signal selected from one of the four elements of the cross with a signal of the fifth central element.

8. The antenna array processor apparatus as recited in claim 6 further comprising a second signal switching means coupled to the four elements at the top most, bottom most, right most and left most positions of the cross for selecting a second signal from the plurality of signals of the four elements and a second signal coupler for coupling the second selected signal with the signal of the central element, the coupling factors of the first and second signal couplers being selected for different frequency bands.

9. The antenna array processor apparatus as in claim 2 wherein said multiple antenna elements include five such elements, each of two pairs of elements being arranged horizontally and the fifth element arranged centrally to the horizontally arranged pairs of elements, the signal switching means and signal coupler arranged to provide four steering beams related to the sum of a signal of the central fifth element and an amplitude weighted summation signal of selected pairs of the four other elements.

10. The antenna array processor apparatus as in claim 1 wherein said elements have coplanar apertures.

11. A method of providing a beam steering signal for automatically tracking a target for use in an antenna system comprising a multiple antenna element array, the elements having parallel-planar apertures, and a signal combining circuit, the method comprising the steps of selecting at least one signal of signals output from the multiple antenna array, amplitude weighting the selected at least one signal, summing in-phase the at least one amplitude weighted signal with at least one other signal of the signals output from the multiple antenna element array, the resulting signal being the beam steering signal for the antenna system.

12. The method of claim 11 wherein the selected at least one signal comprises two signals, the two signals being added together before amplitude weighting.

13. The method of claim 11 wherein the at least one other signal comprises two signals, the two signals being added together before summing in-phase with the selected amplitude weighted signal.

14. The method of claim 11 wherein the at least one signal selected for amplitude weighting comprises the summation of two selected signals and the at least one other signal comprises the summation of two other selected signals.

15. The method of claim 11 wherein the amplitude weighting step particularly comprises weighting signals by first and second amplitude weighting factors selected to be frequency dependent.

16. The method of claim 15 further comprising the step of controlling the value of the first and second amplitude weighting factors.

17. The method of claim 11 further comprising the step of controlling the value of an amplitude weighting factor of the amplitude weighting step.

18. Antenna array processor apparatus for automatically tracking a target comprising multiple antenna elements of a multi-element antenna feed, the elements of the array having parallel planar apertures, a signal switching means coupled to the multiple antenna elements for selecting at least one signal of at least one element from the plurality of signals of the multiple antenna elements and a signal coupler for coupling the at least one selected signal in-phase with at least one other signal of another element, the other element being offset from the at least one element, to produce an antenna beam steering signal.

19. The antenna array processor apparatus as in claim 18 wherein said elements have coplanar apertures.

20. A method of providing a steering signal for an antenna system comprising a multiple antenna element array and a signal combining circuit, the signal combining circuit having associated first and second amplitude weighting factors, the method characterized by the step of predetermining the first and second amplitude weighting factors for first and second frequency bands, respectively.

21. A signal combining circuit for use with a multi-element antenna array for automatically tracking a target, the elements having parallel-planar apertures, comprising a signal switching network coupled to the multi-element antenna array for switchably selecting one signal from a plurality of signals output from the multi-element antenna array, and a signal coupler for coupling the selected one signal in-phase with another signal output of the multi-element antenna array to produce an antenna beam steering signal.

22. The signal combining circuit of claim 21 wherein the signal combining circuit has an associated amplitude weighting factor for amplitude weighting of the selected one signal or the other signal.

23. The signal combining circuit of claim 22, the signal combining circuit, responsive to amplitude weighting control signals, controlling the value of the associated amplitude weighting factor.

24. Antenna array processor apparatus for automatically tracking a target comprising multiple antenna elements of a multi-element antenna feed, the elements arranged with peripherally located elements and a centrally located element, a signal switching means coupled to the peripheral elements for selecting at least one signal from a plurality of signals of the peripheral elements and a signal coupler for coupling a signal from the centrally located element to the at least one selected signal of the peripheral element signals to produce an antenna beam steering signal.

25. The antenna array processor apparatus as in claim 24 wherein said elements have coplanar apertures.

26. The antenna array processor apparatus as in claim 24 wherein the coupled signal is in-phase with the at least one selected signal to which it is coupled.

27. The antenna array processor apparatus as in claim 26 wherein said coupling results in an amplitude weighted signal for antenna beam steering.

28. The antenna array processor apparatus as in claim 26 wherein said multiple antenna elements include five such elements arranged in the form of a cross with a top most element and a bottom most element positioned along a vertical axis, a right most element and a left most element positioned along a horizontal axis, and a fifth element centrally located in relation to the other four elements.

29. The antenna array processor apparatus as in claim 28 wherein four selected beams result such that each beam is an amplitude weighted combination of a signal selected from one of the top most, bottom most, right most or left most elements with a signal of the fifth central element of the cross.

30. The antenna array processor apparatus as recited in claim 28 further comprising a second signal switching means coupled to the four antenna elements at the top most, bottom most, right most and left most positions of the cross for selecting a second signal from the four elements and a second signal coupler for coupling the second selected signal with the signal of the central element, the coupling factors of the signal couplers being selected for different frequency bands.

31. The antenna array process apparatus as in claim 26 wherein said multiple antenna elements include five such elements, each of two pairs of elements being arranged horizontally and the fifth element arranged centrally to the horizontally arranged pairs of elements, the signal switching means and signal coupler arranged to provide four steering beams related to the sum of the signal of the central fifth element and an amplitude weighted summation signal of selected pairs of the four other elements.

32. Antenna array processor apparatus for automatically tracking a target comprising multiple antenna elements of a multi-element antenna feed, said multiple antenna elements include four peripheral elements arranged in the form of a cross with a top most element and a bottom most element positioned along a vertical axis and a right most element and a left most element positioned along a horizontal axis and a fifth central element, a signal switching means coupled to the peripheral elements for selecting from a plurality of signals of the peripheral elements and a signal coupler for coupling a selected signal of one of the plurality of peripheral antenna element signals in-phase with signal of the central element of the multi-element antenna feed to produce an antenna beam steering signal.

33. The antenna array processor apparatus as in claim 32 wherein four selected beams result such that each beam is an amplitude weighted combination of a signal selected from one of the top most, bottom most, right most or left most elements with a signal of the fifth central element of the cross.

34. The antenna array processor apparatus as recited in claim 32 further comprising a second signal switching means coupled to the peripheral elements for selecting a second signal from the plurality of signals of the peripheral elements and a second signal coupler for coupling the second selected signal with the signal of the central element, coupling factors of the first and second signal couplers being selected for different frequency bands.

35. Antenna array processor apparatus comprising multiple antenna elements of a multi-element antenna feed, said multiple antenna elements include five such elements, each of two pairs of elements being arranged horizontally and the fifth element arranged centrally to the horizontally arranged pairs of elements, a signal switching means coupled to the horizontally arranged pairs of elements and a signal coupler, the signal switching means and signal coupler arranged to provide four steering beams related to the sum of the signal of the central fifth element and an amplitude weighted summation signal of selected pairs of the four other elements.

36. The antenna array apparatus as recited in claim 35 wherein the four steering beams produce an antenna beam steering signal for automatically tracking a target.

37. A method for providing a beam steering signal for automatically tracking a target for use in an antenna system comprising a multiple antenna element array having a central element and a signal combining circuit, the method comprising the steps of selecting at least one signal of signals output from the multiple antenna element array, the at least one signal not output from the central element, amplitude weighting the selected at least one signal, summing the at least one amplitude weighted signal with the signal output from the central element of the multiple antenna element array, the resulting signal being the beam steering signal for the antenna system.

38. The method of claim 37 wherein the selected at least one signal comprises two signals, the two signals being added together before amplitude weighting.

39. The method of claim 37 wherein the at least one other signal comprises two signals, the two signals being added together before summing with the selected amplitude weighted signal.

40. The method of claim 37 wherein the at least one signal selected for amplitude weighting comprises the summation of two selected signals which are amplitude weighted by a first amplitude weighting factor and at least another selected signal which is amplitude weighted by a second amplitude weighting factor.

41. The method of claim 47 wherein the amplitude weighting step particularly comprises weighting signals by first and second amplitude weighting factors selected to be frequency dependent.

42. The method of claim 41 further comprising the step of controlling the value of the first and second amplitude weighting factors.

43. The method of claim 37 further comprising the step of controlling the value of an amplitude weighting factor of the amplitude weighting step.

44. Antenna array processor apparatus for automatically tracking a target comprising multiple antenna elements of a multi-element antenna feed, the array having a central element, a signal switching means coupled to the multiple antenna elements for selecting at least one signal of at least one element from a plurality of signals of the multiple antenna elements and a signal coupler for coupling the at least one selected signal with at least one other signal of another element, the other element being offset from the at least one element, to produce an antenna beam steering signal.

45. A signal combining circuit for use with a multi-element antenna array for automatically tracking a target, the array having a central element, comprising a signal switching network coupled to the multi-element antenna array for switchably selecting one signal from a plurality of signals output from the multi-element antenna array, the selected one signal not being output from the central element, and a signal coupler for coupling the selected one signal in-phase with another signal output of the central element of the multi-element antenna array to produce an antenna beam steering signal.

46. The signal combining circuit of claim 45 wherein the signal combining circuit has an associated amplitude weighting factor for amplitude weighting of the selected one signal or the other signal.

47. The signal combining circuit of claim 46, the signal combining circuit, responsive to amplitude weighting control signals, controlling the value of the associated amplitude weighting factor.

48. Antenna array processor apparatus for automatically tracking a target comprising multiple elements of a multiple-element, planar array antenna feed for a reflector or lens antenna, a signal switching means coupled to the multiple antenna elements for selecting from a plurality of signals of the multiple antenna elements and a signal coupler for coupling a selected signal of one of the plurality of antenna element signals with another signal of the multi-element feed for the antenna to produce an antenna beam steering signal.

49. The antenna array processor apparatus as in claim 48 wherein the coupled signal is in-phase with the other signal to which it is coupled.

50. The antenna array processor apparatus as in claim 49 wherein the coupling results in an amplitude weighted signal with the array phase center controlled to effect beam steering.

* * * * *